US007783477B2

(12) United States Patent
D'Haes

(10) Patent No.: US 7,783,477 B2
(45) Date of Patent: Aug. 24, 2010

(54) HIGHLY OPTIMIZED NONLINEAR LEAST SQUARES METHOD FOR SINUSOIDAL SOUND MODELLING

(75) Inventor: Wim D'Haes, Hasselt (BE)

(73) Assignee: Universiteit Antwerpen, Antwerp (BE)

( * ) Notice: Subject to any disclaimer, the term of this patent is extended or adjusted under 35 U.S.C. 154(b) by 1102 days.

(21) Appl. No.: 10/581,141

(22) PCT Filed: Dec. 1, 2004

(86) PCT No.: PCT/EP2004/013630

§ 371 (c)(1),
(2), (4) Date: May 31, 2006

(87) PCT Pub. No.: WO2005/055202

PCT Pub. Date: Jun. 16, 2005

(65) Prior Publication Data

US 2007/0124137 A1 May 31, 2007

(30) Foreign Application Priority Data

Dec. 1, 2003 (WO) ..... PCT/BE03/00207

(51) Int. Cl.
*G10L 19/02* (2006.01)
*G10L 19/00* (2006.01)

(52) U.S. Cl. ..... 704/203; 704/500

(58) Field of Classification Search ..... None
See application file for complete search history.

(56) References Cited

U.S. PATENT DOCUMENTS 4,973,111 A * 11/1990 Haacke et al. ..... 324/309

FOREIGN PATENT DOCUMENTS

WO WO 95/30983 11/1995

OTHER PUBLICATIONS

Li et al., "Computationally efficient parameter estimation for harmonic sinusoidal signals", Signal Processing, vol. 80, Issue 9, pp. 1937-1944, 2000.*

Zeytinoglu et al., "Detection of Harmonic Sets", IEEE Transactions on Signal Processing, vol. 43, Issue 11, pp. 2618-2630, 1995.*

David, et al. "Refining the Digital Spectrum," *Circuits and Systems*, IEEE 39$^{th}$ Midwest Symposium on Ames, IA, USA, Aug. 18-21, 1996, New York NY. vol. 2, pp. 767-770, Aug. 18, 1996.

D'Haes, "A Highly Optimized Nonlinear Least Squares Technique for Sinusoidal Analysis: From $O(K^2N)$ to $O(N\log(N))$," Preprint of the 116$^{th}$ Convention of the Audio Engineering Society, May 8-11, 2004, , pp. 1-12, Berlin, Germany.

(Continued)

*Primary Examiner*—David R Hudspeth
*Assistant Examiner*—Brian L Albertalli
(74) *Attorney, Agent, or Firm*—Knobbe, Martens, Olson & Bear, LLP

(57) ABSTRACT

A method for modelling, i.a. analyzing and/or synthesizing, a windowed signal such as sound or speech signals, by computing the frequencies and complex amplitudes from the signal using a nonlinear least squares method is disclosed. The computations complexity is reduced by taking into account the bandlimited property of a window.

19 Claims, 13 Drawing Sheets

OTHER PUBLICATIONS

Karvonen, "Gauss-Newton-Levenberg-Marquardt-Method," Online (URL:http://www.water.hut.fi/{tkarvone/sgh_544.htm), May 17, 2003, pp. 1-5.

Mength, "Lecture 5: Discrete Fourier Transform," Handout at Stanford University, Feb. 9, 2003.

D'Haes, "A Highly Optimized Method for Computing Amplitudes Over a Windowed Short Time Signal: From $O(K^2N)$ to $O(N\log(N))$," Proceedings of the Fourth IEEE Benelux Signal Processing Symposium, Apr. 2004, pp. 1-4, Hilvarenbeek, The Netherlands.

International Search Report dated Mar. 21, 2005.

* cited by examiner

HIGHLY OPTIMIZED NONLINEAR LEAST SQUARES METHOD FOR SINUSOIDAL SOUND MODELLING

RELATED APPLICATIONS

This application is the U.S. National Phase under 35 U.S.C. §371 of International Application PCT/EP2004/013630, filed Dec. 1, 2004 which claims priority to PCT/BE03/00207, filed Dec. 1, 2003.

FIELD OF THE INVENTION

The present invention relates to the sinusoidal modelling (analysis and synthesis) of musical signals and speech. The analysis computes for a windowed signal of length N, a set of K amplitudes, phases and frequencies using nonlinear least squares estimation techniques. The synthesis comprises the reconstruction of the signal from these parameters. Methods are disclosed for three different models being; 1) a stationary sinusoidal model with arbitrary frequencies, 2) a stationary sinusoidal model with several series of harmonic frequencies and 3) a nonstationary model with complex polynomial amplitudes of order P. It is disclosed how the computational complexity can be reduced significantly by using any window with a bandlimited frequency response. For instance, the complex amplitude computation for the first model is reduced from $O(K^2N)$ to $O(N \log N)$. In addition, a scaled table look-up method is disclosed which allows to use window lengths which are not necessarily a power of two.

BACKGROUND OF THE INVENTION

The sinusoidal modelling of sound signals such as music and speech is a powerful tool for parameterizing sound sources. Once a sound has been parameterized, it can be synthesized for example, with a different pitch and duration.

A sampled short time signal $x_n$ on which a window $w_n$ is applied may be represented by a model $\tilde{x}_n$, consisting of a sum of K sinusoids which are characterized by their frequency $w_k$, phase $\phi_k$ and amplitude $a_k$, $$\tilde{x}_n = w_n \sum_{k=0}^{K-1} a_k \cos\left(2\pi\omega_k \frac{n-n_0}{N} + \phi_k\right) \tag{1}$$

The offset value $n_0$ allows the origin of the timescale to be placed exactly in the middle of the window. For a signal with length N, $n_0$ equals $$\frac{N-1}{2}.$$

If the signal would be synthesized by a bank of oscillators, the complexity would be O(NK) with N being the number of samples and K the number of sinusoidal components. As described in patent WO 93/03478, the computational efficiency of the synthesis can be improved by using an inverse fourier transform. However, the method requires the use of a window length which is a power of two and does not allow nonstationary behavior of the sinusoids within the window.

In "Refining the digital spectrum", Circuits and Systems, 1996, by P. David and J. Szczupak, a method is described which allows to estimate the amplitudes and frequencies.

This method relies on two spectra of which the second one is delayed in time. In addition the effect of the window is reduced by a matrix inversion which requires a complexity $O(K^3)$ for a K×K matrix.

The amplitude estimation methods of the prior art can be categorized in two classes:

- Sequential methods compute the parameters for each sinusoid in a sequential manner, i.e. sinusoid by sinusoid. Several methods have been claimed previously:
  1. WO 90/13887 discloses the estimation of the amplitudes by detecting individual peaks in the magnitude spectrum, and performing a parabolic interpolation to refine the frequency and amplitude values.
  2. In WO 93/04467 and WO 95/30983 a least mean squares method called analysis-by-synthesis/overlap-add (ABS/OLA) is disclosed for individual sinusoidal components.
- The sequential methods have the advantage that they can be computed very efficiently. However, in case of overlapping frequency responses their result is suboptimal which makes that they cannot be applied when small analysis windows are used. Therefore, the use of large analysis windows is required. However, the definition of the model relies implicitly on the assumption that the amplitudes and frequencies are constant over the analysis window. This assumption is not valid in the case of large analysis windows and results in a poor quality.
- Simultaneous methods allow to take into account the overlap between the frequency responses of different sinusoidal components. A method which takes into account the overlap allows to use smaller analysis windows and results in a better quality since the assumption of constant amplitude and frequency is more likely to hold. However, the methods of the prior art known from the literature have a high computational complexity. For instance, the time complexity for the amplitude computation of stationary sinusoids is $O(K^2N)$.

There is a need for a simultaneous method for analyzing sound signals with a lower computational complexity.

SUMMARY OF THE INVENTION

The present invention relates to the modelling (analysis and synthesis) of musical signals and speech and provides therefore highly optimized nonlinear least squares methods.

In section 1 an introduction to the invention is given. Three different sinusoidal models are presented in subsection 1.1. An overview of the nonlinear least squares methodology is described in section 1.2 and illustrated by FIG. 1. The computational complexity can be reduced significantly by using a window with a bandlimited frequency response. Subsection 1.3 describes such a window and its frequency response is illustrated by FIGS. 2 and 3.

Section 2 discusses efficient spectrum computation methods for the different models and is illustrated by FIG. 4.

Section 3 discloses a highly optimized least squares method for the computation of the complex amplitudes. First, the time domain derivation is described in subsection 3.2, which is transformed to the frequency domain in section 3.3. It is shown that the bandlimited property of the frequency response of the square window results in a band diagonal system matrix as depicted in FIG. 5. This makes that the system can be solved in linear time instead of a power three complexity. The amplitude estimation algorithm is illustrated by FIG. 6.

Section 4 describes frequency optimization methods for the stationary nonharmonic signal, as there are 1. Gradient based methods (section 4.1)
2. Gauss-Newton optimization (section 4.2)
3. Levenberg-Marquardt optimization (section 4.3)
4. Newton optimization (section 4.4)

These methods are unified in section 4.5 where two parameters $\lambda_1$ and $\lambda_2$ allow to switch between different optimization methods. The frequency optimization algorithm is depicted in FIG. 7.

Section 5 discloses the frequency optimization for the harmonic model. Efficient algorithms for gradient-based (subsection 5.1), Gauss-Newton (subsection 5.2), Levenberg-Marquardt (subsection 5.3) and Newton (subsection 5.4) optimization are disclosed and unified in (subsection 5.5). The frequency optimization algorithms for the harmonic model are depicted in FIG. 8 and FIG. 9.

Section 6 shows that the amplitude estimation method can be extended to the complex polynomial amplitude model described in subsection 6.1. Subsection 6.2 discloses how the system matrix can be made band diagonal as is illustrated by FIG. 10. The complete algorithm is depicted by FIG. 11. In subsection 6.3 it is derived how the instantaneous phases and amplitudes can be computed from the complex polynomnial amplitudes. It is shown that the instantaneous frequency can be used as a new estimate of the frequency. The instantaneous amplitude can also be interpreted as a damped function. It is shown how the damping factor can be computed.

All previous methods axe based on the computation of the frequency responses by using look-up tables. Normally, it is desired that the window length is a power of two so that an FFT can be used. In section 7 it is disclosed that it is possible to use a shorter window and to zero-pad the signal up to a power of two length. This results in a scaling of the frequency responses. An illustration is provided by FIG. 12.

Section 8 describes a preprocessing routine which determines the number of diagonal bands D that are relevant.

Section 9 describes several applications which are facilitated by the invention, as there are 1. arbitrary sample rate conversion (subsection 9.1)
2. high resolution (multi-)pitch estimation (subsection 9.2)
3. parametric audio coding (subsection 9.3)
4. source separation (subsection 9.4)
5. automated annotation and transcription (subsection 9.5)
6. audio effects (subsection 9.6)

Several applications are depicted in FIG. 13.

DETAILED DESCRIPTION OF THE INVENTION

1 Introduction

1.1 The Signal Models

The present invention discloses highly optimized non linear least squares methods for sinusoidal modelling of audio and speech. Depending on the assumptions that can be made about the signal, three types of models axe considered 1. A model with K stationary components where each component is characterized by its complex amplitude $A_k$ and frequency $\omega_k$. This model is called stationary since the amplitudes and frequencies are constant over time. In addition, the model includes the analyses window $w_n$.

$$\tilde{x}_n = \Re\left[w_n \sum_{k=0}^{K-1} A_k \exp\left(-2\pi i \omega_k \frac{n-n_0}{N}\right)\right] \tag{2}$$

2. A model with S quasi-periodic stationary sound sources with a fundamental frequency $\omega_k$, each consisting of $S_k$ sinusoidal components with frequencies that are integer multiples of $\omega_k$. The complex amplitude of the pth component of the kth source is denoted $A_{k,p}$. The window $w_n$ is taken in account.

$$\tilde{x}_n = \Re\left[w_n \sum_{k=0}^{S-1} \sum_{p=0}^{S_k-1} A_{k,p} \exp\left(-2\pi i p \omega_k \frac{n-n_0}{N}\right)\right] \tag{3}$$

3. A model with K nonstationary sinusoidal components which have independent frequencies $\omega_k$. The amplitudes $A_{k,p}$ denote the p-th order of the k-th sinusoid. The window $w_n$ is taken into account.

$$\tilde{x}_n = \Re\left[w_n \sum_{k=0}^{K-1} \sum_{p=0}^{P-1} A_{k,p} \left(-2\pi i \frac{n-n_0}{N}\right)^p \exp\left(-2\pi i \omega_k \frac{n-n_0}{N}\right)\right] \tag{4}$$

1.2 A Highly Optimized Non Linear Least Squares Method

The goal of the nonlinear least squares method consists of determining the frequencies and complex amplitudes for these different models by minimizing the square difference between the model $\tilde{x}_n$ and a recorded signal $x_n$.

$$\sum_{n=0}^{N-1}(x_n-\tilde{x}_n)^2 \tag{5}$$

This difference $r_n$ defined as $$r_n \equiv x_n - \tilde{x}_n \tag{6}$$

is called the residual. For a given set of frequencies, the amplitudes can be computed analytically by a standard least squares procedure. The frequencies on the other hand cannot be computed analytically and are optimized iteratively. Applying the frequency optimization and amplitude computation in an alternating manner is called a nonlinear least squares method.

Figure 1:
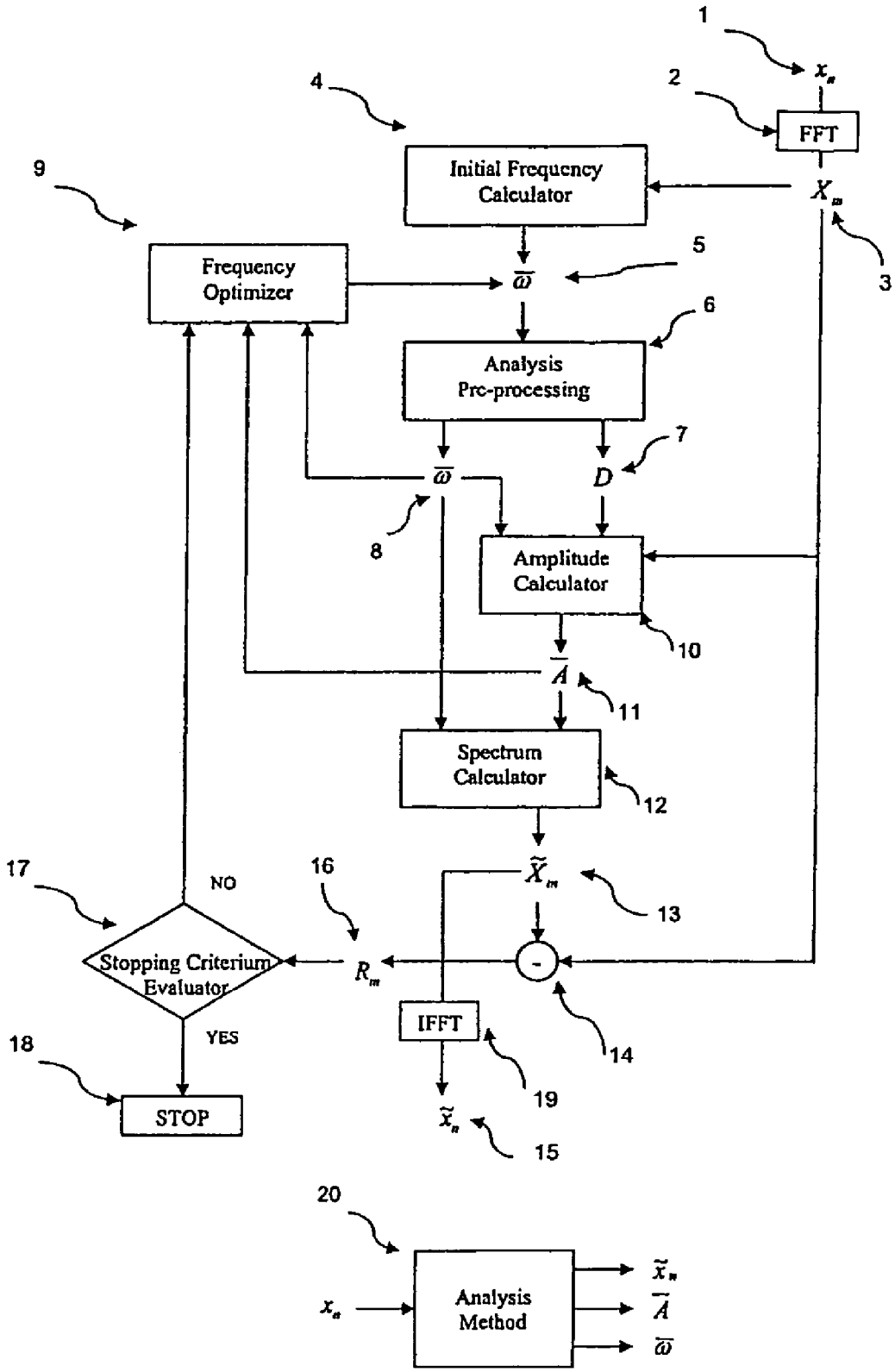
FIG. 1 depicts an overview of the complete nonlinear least square method for sinusoidal modelling.

FIG. 1, depicts the complete analysis/synthesis method according to the embodiment of the invention. First, the initial values for the frequencies $\omega_k$ are determined. For the stationary model with independent frequencies and the non stationary model, this consists of a simple peak picking. For the harmonic stationary sources a (multi-)pitch estimator can be used.

The frequencies at iteration r are denoted $\overline{\omega}^{(r)}$ yielding for the initial frequencies $\overline{\omega}^{(0)}$. With these initial frequencies the amplitudes $\overline{A}$ are computed. The amplitudes $\overline{A}$ and frequencies $\overline{\omega}$ allow to compute the spectrum $\tilde{X}_m$. When the model spectrum $\tilde{X}_m$ is subtracted from the signal spectrum $X_m$ the residual spectrum $R_m$ is obtained. Using the residual spectrum $R_m$, the amplitudes $\overline{A}$ and frequencies $\overline{\omega}^{(r)}$, the frequency optimization step $\Delta\overline{\omega}$ is computed which allows to compute the frequency value for the next iteration $$\overline{\omega}^{(r+1)}=\overline{\omega}^{(r)}+\Delta\overline{\omega} \tag{7}$$

This iterative loop is continued until a stopping criterium is met such as

- stop after a fixed number of iterations
- stop after a fixed computation time
- stop when the error function drops below a specified value
- stop when the error change drops below a specified value
- stop when the error function starts to increase.

Figure 2:
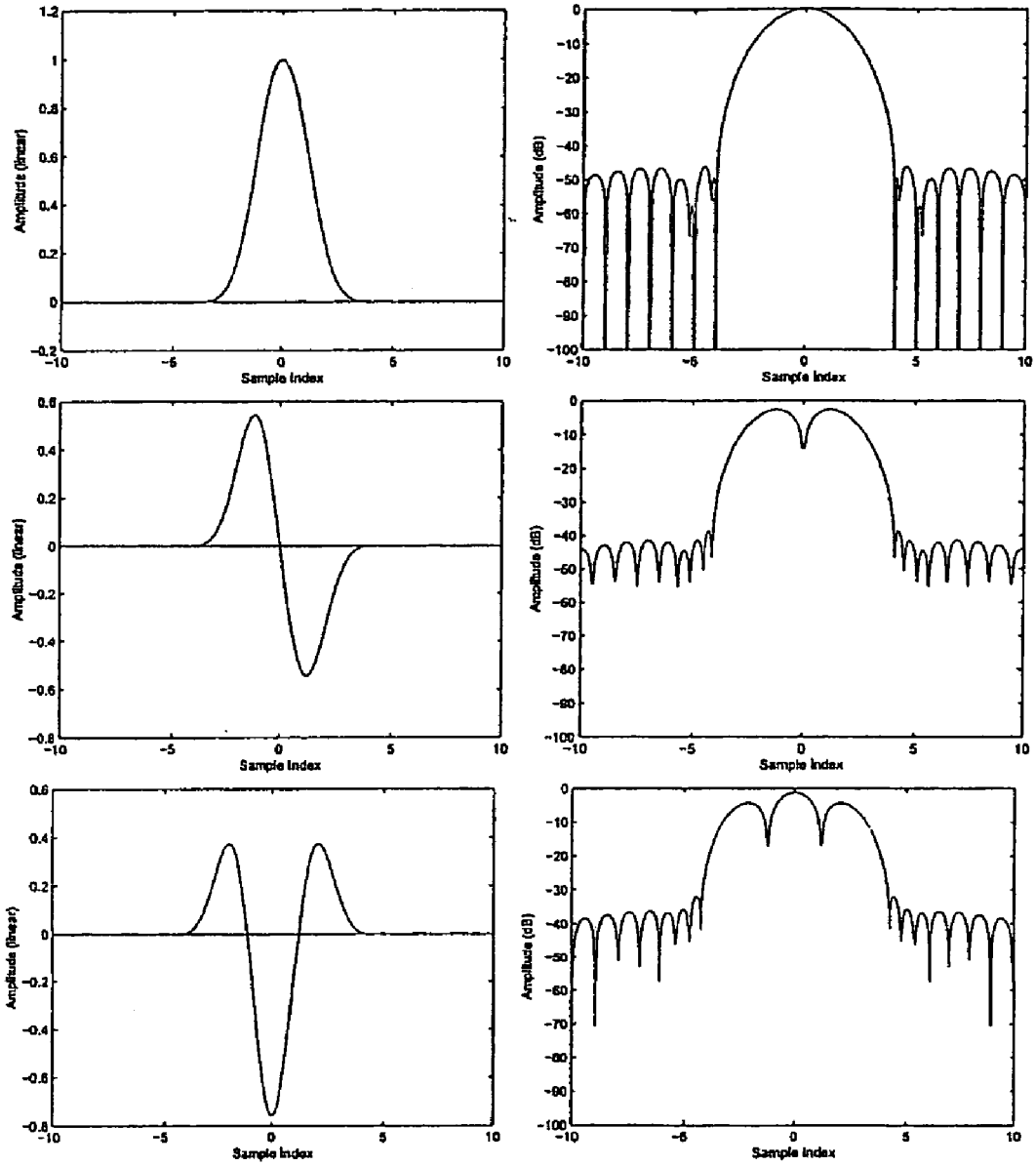
FIG. 2 depicts the frequency responses of the Blackmann-Harris window and the first and second derivative of frequency response.
Figure 3:
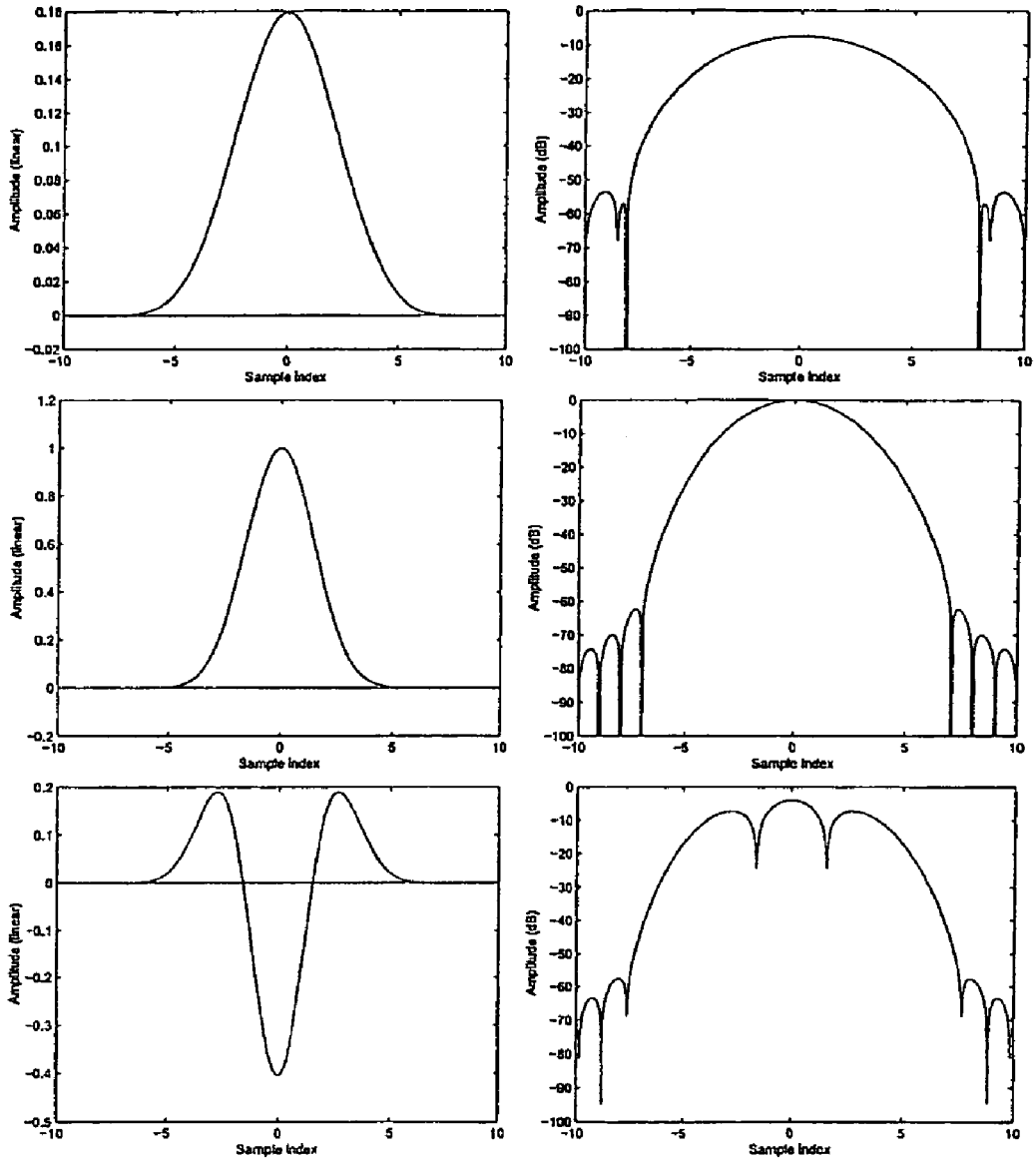
FIG. 3 depicts the frequency responses of the zero padded Blackmann-Harris window, the frequency response of the squared window and its second derivative.

Using prior art methods, the practical applications the nonlinear least squares methods are prohibited by their computational demands. The contributions which are disclosed in this invention are algorithms which realize significant computational gains for 1. the spectrum computation
2. the amplitude computation
3. the frequency optimization 1.3 Window Choice A crucial element in order to obtain this computational gain is to choose a window with a bandlimited frequency response. This means that the frequency response of the window W(m) is assumed to be zero outside the interval $-\beta<m<\beta$. In particularly, but not exclusively, we consider the Blackmann-Harris window $$w_n = a + b\cos\left(2\pi_n\frac{n-n_0}{N}\right) + c\cos\left(4\pi\frac{n-n_0}{N}\right) + d\cos\left(6\pi\frac{n-n_0}{N}\right) \tag{8}$$

with a=0.35875, b=0.48829, c=0.14128 and d=0.01168. The frequency response of the Blackmann-Harris window is shown in FIG. 2. Any other window with a bandlimited frequency response can be applied. Throughout the description of the invention, the bandlimited property of the frequency response of the window will play a crucial role. In addition, the derivatives of the frequency response are also bandlimited. Taking the derivative of the frequency responses is equivalent with multiplying the window with a straight line as shown by Eq. (9). Also the frequency response of the square window is bandlimited which can be understood easily taking into account that taking the square in the time domain is equivalent with a convolution in the frequency domain. This however, doubles, the size of the main lobe. These frequency responses are illustrated in FIG. 3.

$$\begin{aligned}
W(m) &= \sum_{n=0}^{N-1} w_n \exp\left(-2\pi i m\frac{n-n_0}{N}\right) \\
W'(m) &= \sum_{n=0}^{N-1}\left(-2\pi i\frac{n-n_0}{N}\right) w_n \exp\left(-2\pi i m\frac{n-n_0}{N}\right) \\
W''(m) &= \sum_{n=0}^{N-1}\left(-2\pi i\frac{n-n_0}{N}\right)^2 w_n \exp\left(-2\pi i m\frac{n-n_0}{N}\right) \\
Y(m) &= \sum_{n=0}^{N-1} w_n^2 \exp\left(-2\pi i m\frac{n-n_0}{N}\right) \\
Y'(m) &= \sum_{n=0}^{N-1}\left(-2\pi i\frac{n-n_0}{N}\right) w_n^2 \exp\left(-2\pi i m\frac{n-n_0}{N}\right) \\
Y''(m) &= \sum_{n=0}^{N-1}\left(-2\pi i\frac{n-n_0}{N}\right)^2 w_n^2 \exp\left(-2\pi i m\frac{n-n_0}{N}\right)
\end{aligned} \tag{9}$$

2 Spectrum Computation

The model defined in Eq. 2 is the real part of the complex signal $$\tilde{x}_n = w_n \sum_{k=0}^{K-1} A_k \exp\left(-2\pi i \omega_k \frac{n-n_0}{N}\right) \tag{10}$$

Taking the fourier transform of this complex signal results in a spectrum $\tilde{X}_m$ defined as $$\tilde{X}_m = \sum_{k=0}^{K-1} A_k W(m+\omega_k) \tag{11}$$

where W(m) denotes the discrete time fourier transform of $w_n$. The spectrum model $\tilde{X}_m$ is a linear combination of frequency responses of the window, which are shifted over $\omega_k$ and weighted with a complex factor $A_k$.

In an analogue manner one obtains for the harmonic model $$\tilde{X}_m = \sum_{k=0}^{S-1} \sum_{p=0}^{S_k-1} A_{k,p} W(m + p\omega_k) \tag{12}$$

and for the non stationary model $$\begin{aligned}\tilde{X}_m &= \sum_{n=0}^{N-1} w_n \left[ \sum_{k=0}^{K-1} \sum_{p=0}^{P-1} A_{k,p} \left(-2\pi i \frac{n-n_0}{N}\right)^p \exp\left(-2\pi i \omega_k \frac{n-n_0}{N}\right) \right] \\ &\quad \exp\left(-2\pi i m \frac{n-n_0}{N}\right) \\ &= \sum_{k=0}^{K-1} \sum_{p=0}^{P-1} A_{k,p} \left[ \sum_{n=0}^{N-1} w_n \left(-2\pi i \frac{n-n_0}{N}\right)^p \right. \\ &\quad \left. \exp\left(-2\pi i (\omega_k + m) \frac{n-n_0}{N}\right) \right] \\ &= \sum_{k=0}^{K-1} \sum_{p=0}^{P-1} A_{k,p} \frac{\partial^p}{\partial m^p} W(\omega_k + m)\end{aligned} \tag{13}$$

Figure 4:
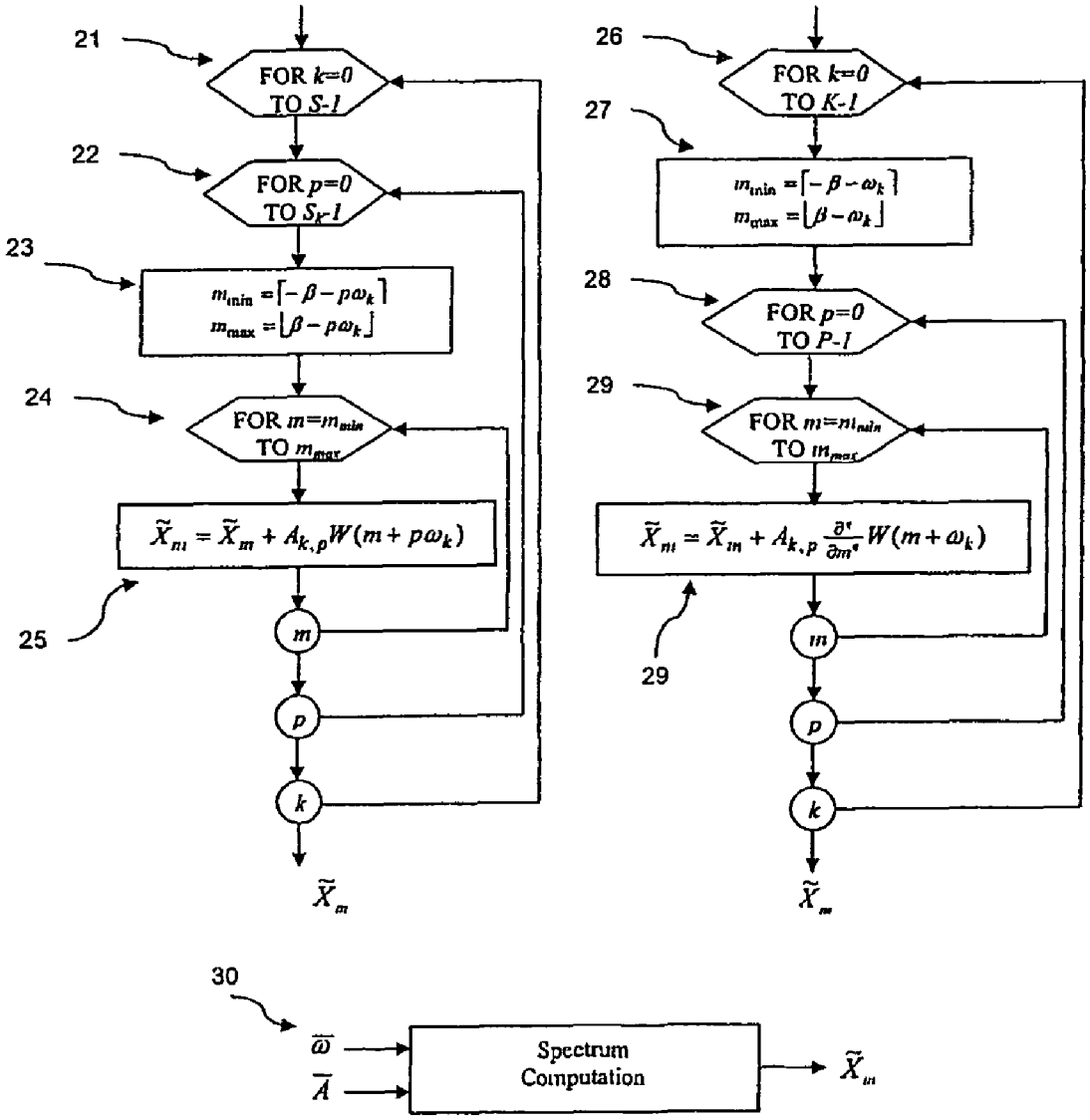
FIG. 4 depicts the optimized spectrum computation method for the harmonic and the nonstationary model.

The spectrum computation is illustrated in FIG. 4.

Conclusion

When $\tilde{x}_n$ would be computed in the time domain this would result in a complexity O(KN). However because of the band-limited property of W(m) only m-values must be considered for which $-\beta \leqq m+w_k \leqq \beta$. As a result, the frequency response of each component can be computed in constant time yielding O(K) for all components and O(N log N) for the inverse fourier transforms. The reduction from O(KN) to O(N log N) is interesting if K is sufficiently large.

Also the derivatives of the frequency response are band-limited and can be computed by look-up tables. This reduces the complexity from O(KPN) for the time domain computation of the nonstationary model to O(KP+N log N) where the first term comes from the spectrum computation second term from the inverse fourier transform. Since the order of the polynomial P is rather small, the second term predominates the complexity.

A preferred embodiment of the method according to the invention, comprises the computation of the spectrum as a linear combination of the frequency responses of the window according to Eq. (11) for the stationary nonharmonic model, Eq. (12) of the harmonic model and Eq. (13) for the nonstationary model, whereby only the main lobes of the responses are computed by using look-up tables. This method reduced the time complexity from O(KPN) to O(N log N).

3 Complex Amplitude Computation

3.1 Introduction

In this section, an efficient least mean squares technique is described for the computation of the complex amplitudes. In WO 90/13887, the estimation of the amplitudes is claimed by detecting individual peaks in the magnitude spectrum, and performing a parabolic interpolation to refine the frequency and amplitude values. In WO 93/04467 and WO 95/30983 a least means squares is presented which is applied iteratively on the signal, subtracting a single sinusoidal component each time.

The major difference with the present invention is that all amplitudes are computed simultaneously for a given set of frequencies. This allows to resolve strongly overlapping frequency responses of sinusoidal components. As will be shown later, the original computational complexity of this method is $O(K^2N)$ where the K denotes the number of partials and N the signal length. The invention however, solves this problem in O(N log N) and reduces the space complexity, which is originally $O(K^2)$, to O(K).

3.2 Complex Amplitude Computation in the Time Domain

The complex amplitude computation is derived in the time domain. Eq. (2) is reformulated as a sum of cosines and sines where the real part of the complex amplitude is denoted $A_k^r = \alpha_k \cos \phi_k$ and the imaginary part as $A_k^i = \alpha_k \sin \phi_k$. The signal model for the short time signal $\tilde{x}_n$ can now be written as $$\begin{aligned}\tilde{x}_n &= w_n \frac{1}{2} \sum_{k=0}^{K-1} \left( A_k \exp\left(-2\pi i \omega_k \frac{n-n_0}{N}\right) + A_k^* \exp\left(2\pi i \omega_k \frac{n-n_0}{N}\right) \right) \\ &= w_n \sum_{k=0}^{K-1} \left( A_k^r \cos\left(2\pi \omega_k \frac{n-n_0}{N}\right) + A_k^i \sin\left(2\pi \omega_k \frac{n-n_0}{N}\right) \right)\end{aligned} \tag{14}$$

The error function $\chi(\overline{A}; \overline{\omega})$ expresses the square difference between the samples in the windowed signal $x_n$ and the signal model $\tilde{x}_n$.

$$\chi(\overline{A}; \overline{\omega}) = \sum_{n=0}^{N-1} (x_n - \tilde{x}_n)^2 \tag{15}$$

This notation indicates that the error is minimized with respect to a vector of variables $\overline{A}$ for a given set of frequencies $\overline{\omega}$ that are assumed to be known. The minimization is realized by putting the derivatives with respect to the unknowns to zero $$\frac{\partial \chi(\overline{A}; \overline{\omega})}{\partial A_l^r} = 0, \quad \frac{\partial \chi(\overline{A}; \overline{\omega})}{\partial A_l^i} = 0 \tag{16}$$

resulting respectively in $$\begin{aligned}&\sum_{k=0}^{K-1} A_k^r \left( \sum_{n=0}^{N-1} w_n^2 \cos\left(2\pi \omega_k \frac{n-n_0}{N}\right) \cos\left(2\pi \omega_l \frac{n-n_0}{N}\right) \right) + \\ &\quad \sum_{k=0}^{K-1} A_k^i \left( \sum_{n=0}^{N-1} w_n^2 \sin\left(2\pi i \omega_k \frac{n-n_0}{N}\right) \cos\left(2\pi \omega_l \frac{n-n_0}{N}\right) \right) = \\ &\quad \sum_{n=0}^{N-1} x_n w_n \cos\left(2\pi \omega_l \frac{n-n_0}{N}\right)\end{aligned} \tag{17}$$

and

-continued $$\sum_{k=0}^{K-1} A_k^r\left(\sum_{n=0}^{N-1} w_n^2\cos\left(2\pi\omega_k\frac{n-n_0}{N}\right)\sin\left(2\pi\omega_l\frac{n-n_0}{N}\right)\right)+\sum_{k=0}^{K-1} A_k^i\left(\sum_{n=0}^{N-1} w_n^2\sin\left(2\pi i\omega_k\frac{n-n_0}{N}\right)\sin\left(2\pi\omega_l\frac{n-n_0}{N}\right)\right)=\sum_{n=0}^{N-1} x_n w_n\sin\left(2\pi\omega_l\frac{n-n_0}{N}\right) \tag{18}$$

These two sets of K equations have 2K unknown variables what can be written in the following matrix form $$\begin{bmatrix} B^{1,1} & B^{1,2} \\ B^{2,1} & B^{2,2} \end{bmatrix}\begin{bmatrix} A^r \\ A^i \end{bmatrix}=\begin{bmatrix} C^1 \\ C^2 \end{bmatrix} \tag{19}$$

with $$B_{l,k}^{1,1}=\sum_{n=0}^{N-1} w_n^2\cos\left(2\pi\omega_k\frac{n-n_0}{N}\right)\cos\left(2\pi\omega_l\frac{n-n_0}{N}\right)$$

$$B_{l,k}^{1,2}=\sum_{n=0}^{N-1} w_n^2\sin\left(2\pi\omega_k\frac{n-n_0}{N}\right)\cos\left(2\pi\omega_l\frac{n-n_0}{N}\right)$$

$$B_{l,k}^{2,1}=\sum_{n=0}^{N-1} w_n^2\cos\left(2\pi\omega_k\frac{n-n_0}{N}\right)\sin\left(2\pi\omega_l\frac{n-n_0}{N}\right)$$

$$B_{l,k}^{2,2}=\sum_{n=0}^{N-1} w_n^2\sin\left(2\pi\omega_k\frac{n-n_0}{N}\right)\sin\left(2\pi\omega_l\frac{n-n_0}{N}\right)$$

$$C_l^1=\sum_{n=0}^{N-1} x_n w_n\cos\left(2\pi\omega_l\frac{n-n_0}{N}\right)$$

$$C_l^2=\sum_{n=0}^{N-1} x_n w_n\sin\left(2\pi\omega_l\frac{n-n_0}{N}\right)$$

Under the condition that every sinusoid has a different frequency, the matrix B cannot have two linear dependent rows. Therefore, it is well conditioned which implies a unique and accurate solution for A.

The computational complexity of this method is very high, for instance, the computation of the matrix B has a complexity $O(K^2N)$ the computation of the matrix C has a complexity $O(KN)$ the solution of the linear set of equations is $O(K^3)$ Note that the order of magnitude of K and N is not significantly different. In the next sections, the complexity is reduced to O(N log N).

3.3 Efficient Complex Amplitude Computation

Several optimizations for the time-domain computation are disclosed. The main computational burden is the construction of the matrices B and C and solving the system of linear equations which have complexity $O(K^2N)$ and $O(K^3)$ respectively. The matrices B and C are expressed in terms of the frequency responses of the window W(m) and square window Y(m) resulting in $$B_{l,k}^{1,1}=\frac{1}{2}\Re\,(Y(\omega_k+\omega_l))+\frac{1}{2}\Re(Y(\omega_k-\omega_l)) \tag{20}$$

$$B_{l,k}^{1,2}=-\frac{1}{2}\Im\,(Y(\omega_k+\omega_l))-\frac{1}{2}\Im(Y(\omega_k-\omega_l))$$

$$B_{l,k}^{2,1}=-\frac{1}{2}\Im\,(Y(\omega_k+\omega_l))+\frac{1}{2}\Im(Y(\omega_k-\omega_l))$$

$$B_{l,k}^{2,2}=-\frac{1}{2}\Re\,(Y(\omega_k+\omega_l))+\frac{1}{2}\Re(Y(\omega_k-\omega_l))$$

$$C_l^1=\Re\left(\frac{1}{N}\sum_{m=0}^{N-1} X_m W(m+\omega_l)\right)$$

$$C_l^2=-\Im\left(\frac{1}{N}\sum_{m=0}^{N-1} X_m W(m+\omega_l)\right)$$

Since the window is real and symmetric, its frequency response is also real and symmetric. Since $B^{1,2}$ and $B^{2,1}$ are expressed in terms of the imaginary part of the frequency response, they only contain zeros. By using the look-up tables for Y(m) in the computation of B the summation over N is eliminating in a complexity $O(K^2)$ instead of $O(K^2N)$. When C is computed, only the w-values need to be considered which fall in the main lobe of W(m) around $\omega_l$ reducing O(KN) to O(K). However, solving the equations still requires $O(K^3)$.

Figure 5:
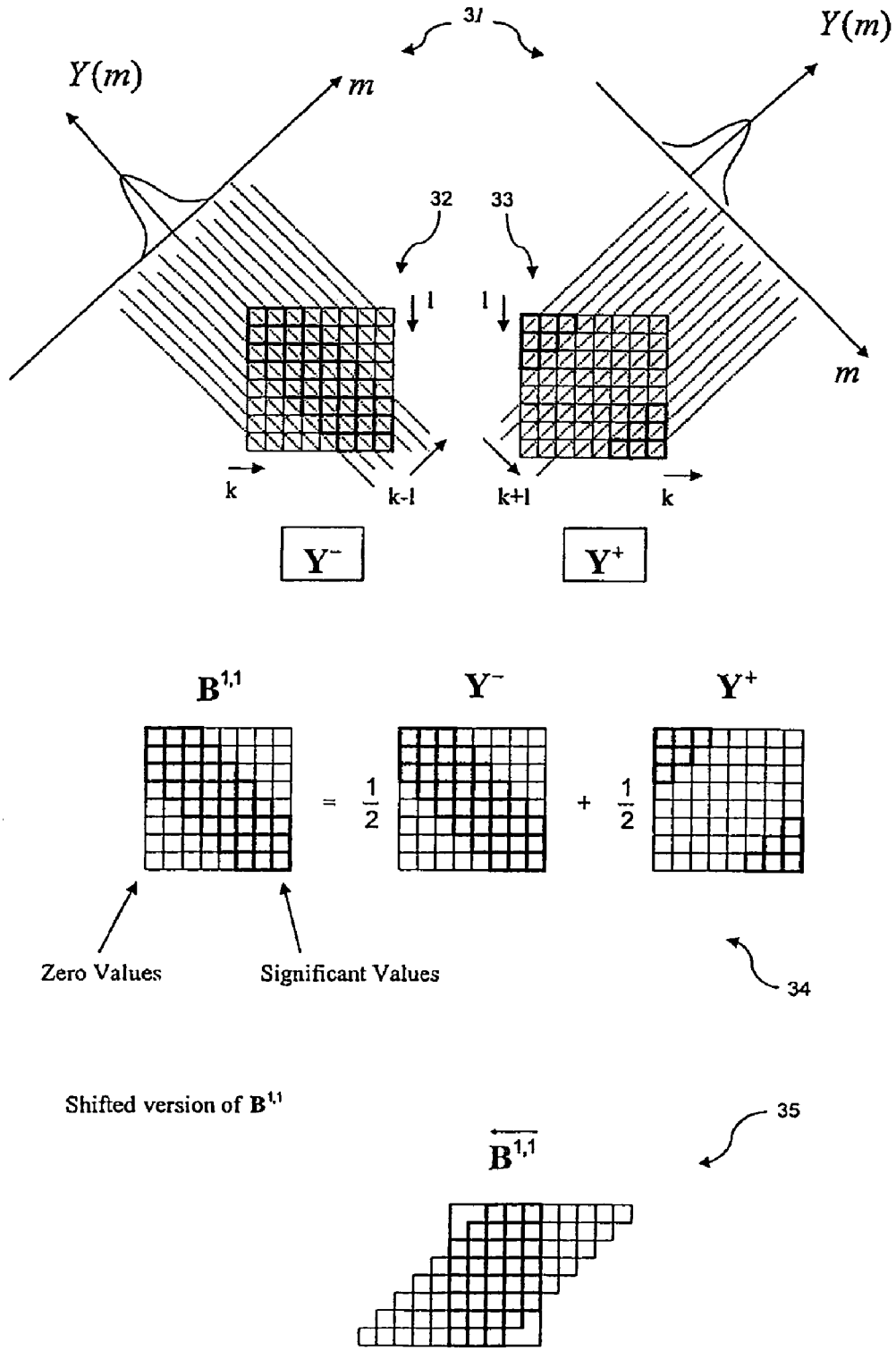
FIG. 5 illustrates the band diagonal property of the system matrix B.

This can again be optimized by taking into account that $B^{1,1}$ and $B^{2,2}$ contain only significant values around the main diagonal. This property is illustrated in FIG. 5 for a single harmonic sound source but also valid for arbitrary frequencies sorted in ascending order.

When defining a matrix $Y^-_{l,k}=\Re(Y(\omega_k-\omega_l))$ and a matrix $Y^+_{l,k}=\Re(Y(\omega_k+\omega_l))$ one obtains $$B^{1,1}=\frac{1}{2}(Y^++Y^-) \tag{21}$$

$$B^{2,2}=-\frac{1}{2}(Y^+-Y^-) \tag{22}$$

In the case of a harmonic sound source, all frequencies are a multiples of the fundamental frequency ω, from which follows that $$Y^-_{l,k}=\Re(Y((k-l)\omega))$$

$$Y^+_{l,k}=\Re(Y((k+l)\omega)) \tag{23}$$

Since both kω and lω lie between zero and $$\frac{N}{2},$$

their difference lies between $$-\frac{N}{2}\text{ and }\frac{N}{2}.$$

By denoting the bandwidth of the main lobe as 2β, and taking into account that only values must be considered that lie within the bandwidth of the frequency response, it follows that $$-\beta \leqq (k-l)\omega \leqq \beta \tag{24}$$

As a result, only the values k−l are considered between $$\left\lceil -\frac{\beta}{\omega} \right\rceil \text{ and } \left\lfloor \frac{\beta}{\omega} \right\rfloor.$$

Since k and l denote the row and column index of $Y^-$, k−l denotes the diagonal. This implies that only 2D+1 diagonal bands must be considered with $$D = \left\lfloor \frac{\beta}{\omega} \right\rfloor \tag{25}$$

The number of diagonal bands is dependent on the bandwidth β of the frequency response and the fundamental frequency ω. For instance, when the window length is chosen to be three periods, ω=3, and knowing that β=8 for the square Blackmann-Harris window, a value of 2 is obtained for D. This means that only the main diagonal and the first two upper and lower diagonals are relevant.

On the other hand, when considering the matrix $Y^+$, the values for (k+l)ω lie between zero and N. The frequency response of the window is in this case divided over the left and right hand side of the interval. When considering the left half of the response, only significant values are obtained when (k+l)ω<β, which yields for ω=3 that k+l≦2. As a result, only significant values are obtained in the upper left corner. For the right hand side of the interval, the main lobe ranges from N−β to N yielding, $$k + l > \frac{N-\beta}{\omega} \tag{26}$$

Note that $$\frac{N}{\omega}$$

corresponds with the maximal possible value of k+l which corresponds with the lower right corner of the matrix. This is illustrated in FIG. 5.

A typical method to solve a linear set of equations is Gaussian elimination with back-substitution. This method has a time complexity $O(K^3)$. However, since the system matrix is band diagonal, this method requires a time complexity $O(D^2K)$. Since D is significantly smaller than K this results finally in O(K).

In addition, the space complexity can be reduced from $O(K^2)$ to O(K) by storing only the diagonal bands. Therefore, shifted matrices are defined $$\overleftarrow{B^{1,1}_{l,k}} = B^{1,1}_{l,l+k-D} \tag{27}$$

-continued $$\overleftarrow{B^{2,2}_{l,k}} = B^{2,2}_{l,l+k-D}$$

where D denotes the number of diagonals that are stored around the main diagonal. Note that l=0, . . . , L−1 and k=0, . . . , 2D. For combinations (k,l) resulting in an index outside B, a zero value is returned. The amplitudes are computed directly from the shifted versions of $B^{1,1}$, $B^{2,2}$. By denoting this routine as SOLVE this is written as $$A^r = \text{SOLVE}\left(\overleftarrow{B^{1,1}}C^1\right) \tag{28}$$

$$A^i = \text{SOLVE}\left(\overleftarrow{B^{2,2}}, C^2\right)$$

Conclusions:

The space complexity of B is reduced from $O(K^2)$ to O(K) by storing it as $\overleftarrow{\mathbf{B}}$. Since each element is computed by a look-up table, the time complexity is also O(K).

The bandlimited property of W(m), makes that the summation over m each element of $C^1$ and $C^2$ according to Eq. (20) can be limited to samples for which −β<m+ω<β. This implies that the computation of each element can be computed in constant time, yielding in O(K) for the whole vector.

A second result of the band diagonal form of B is that the system can now be solved in O(K) instead of $O(K^3)$.

The main computational bottleneck is the FFT for the computation of $X_m$ which requires a complexity O(N log N).

Figure 6:
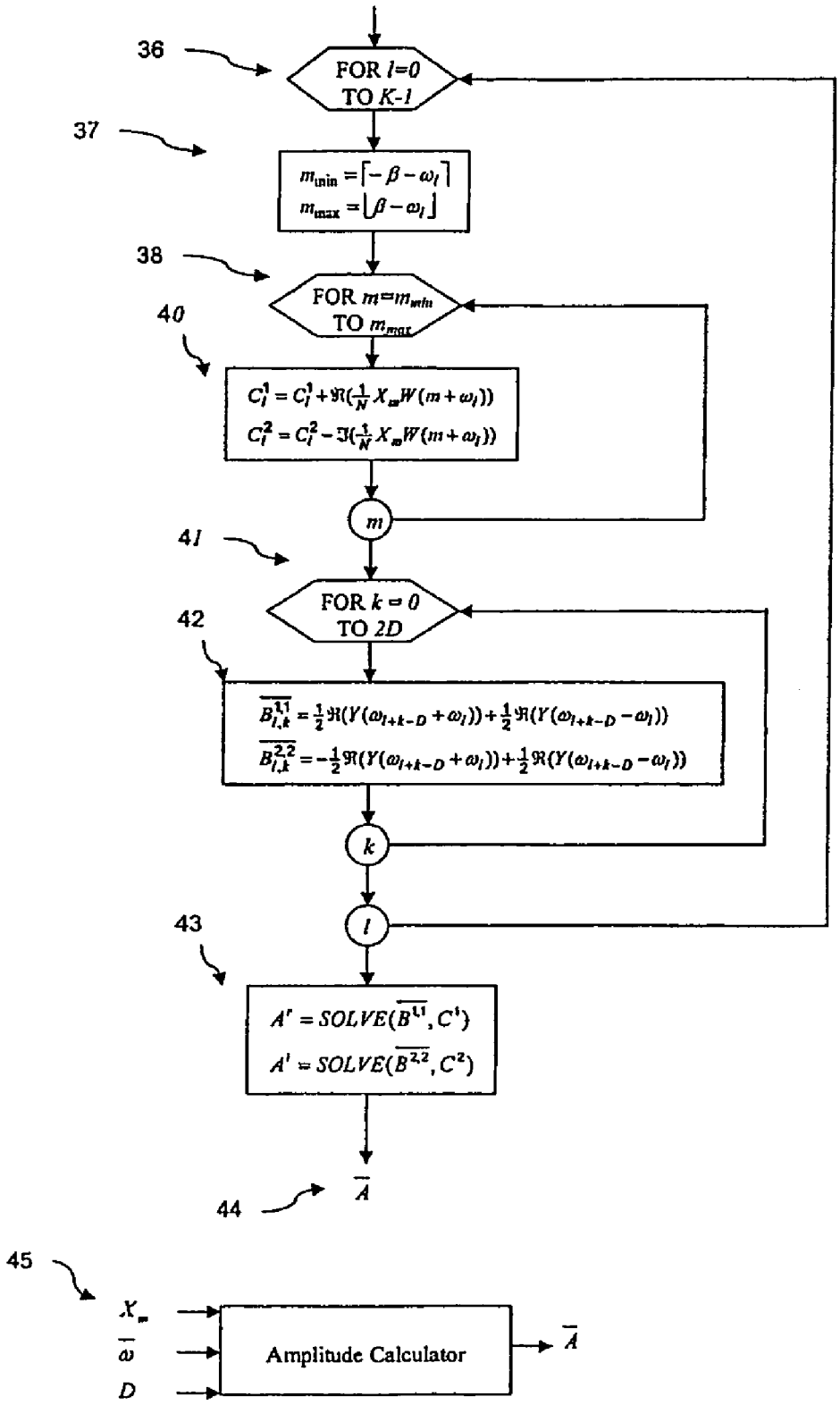
FIG. 6 depicts the optimized amplitude computation.

The amplitude computation is illustrated in FIG. 6.

A preferred embodiment of the method according to the invention, comprises the step of computing the stationary complex amplitudes, by solving the equations given in Eq. (19), using Eq. (20) such that only the elements around the diagonal of B are taken into account, whereby a shifted form $\overleftarrow{\mathbf{B}}$ is computed containing only D diagonal bands of B according to Eq. (27) and Eq. (20), whereby the computation of the Eq. (20) requires the computation of the frequency response of the window and the square window denoted by W(m) and Y(m) respectively, and solving equation given by Eq. (19) directly from $\overleftarrow{\mathbf{B}}$ and C (Eq. (28)) by an adapted gaussian elimination procedure.

4. Frequency Optimization for the Stationary Model

In this section, methods are disclosed which allow to optimize the frequency values for the stationary model with independent components. The signal model given in Eq. (2) is written as $$\tilde{x}_n = w_n \frac{1}{2}\sum_{k=0}^{K-1}\left(A_k \exp\left(-2\pi i \omega_k \frac{n-n_0}{N}\right) + A_k^* \exp\left(2\pi i \omega_k \frac{n-n_0}{N}\right)\right) \tag{29}$$

A variety of iterative methods are known which allow to improve the frequency values $\overline{\omega}$. By denoting the iteration index as $^{(r)}$ one obtains $$\overline{\omega}^{(r+1)} = \overline{\omega}^{(r)} + \Delta\overline{\omega} \tag{30}$$

The invention comprises methods to calculate the optimization step $\Delta\omega$ in an efficient manner. In the following subsections it is disclosed how the computational complexity of some well-known optimization techniques can be reduced to O(N log N) while their time-domain equivalent has a complexity $O(K^2N)$.

We consider 1. gradient based methods
2. Gauss-Newton optimization
3. Levenberg-Marquardt optimization
4. Newton optimization 4.1 Gradient Based Methods A first class of optimization algorithms are based on the gradient of the error function defined by $$h_l \equiv \frac{\partial X(\overline{\omega}; \overline{A})}{\partial \omega_l}$$

One simple method for the optimization consists of computing the optimization step as $$\Delta\overline{\omega} = -\eta h \tag{31}$$

where $\mu$ is called the learning rate. When the gradient is computed for the model given in Eq. (29) and expressed in the frequency domain one obtains $$h_l = -\frac{2}{N}\Re\left(A_l \sum_{m=0}^{N-1} R_m W'(\omega_l - m)\right) \tag{32}$$

where $R_m = X_m - \tilde{X}_m$ denotes the spectrum of the residual $r_n$ and W'(m) the derivative of the frequency response W(m).

Conclusion

Analogue to the computation of $C^1$ and $C^2$ given by Eq. (20), the bandlimited property of W'(m) results in the fact that only m-values within the main lobe of the response must be considered reducing computational complexity for the gradient from O(KN) to O(K).

4.2 Gauss-Newton Optimization

A second well-known method is called Gauss-Newton optimization and consists of making a first order Taylor approximation of the signal model around an initial estimate of the frequencies denoted as $\hat{\overline{\omega}}$. When making a first order approximation of the signal model given by $$w_n \exp\left(-2\pi i \omega_k^{\frac{n-n_0}{N}}\right) \approx w_n \exp\left(-2\pi i \hat{\omega}_k^{\frac{n-n_0}{N}}\right) + w_n\left(-2\pi i^{\frac{n-n_0}{N}}\right)\exp\left(-2\pi i \hat{\omega}_k^{\frac{n-n_0}{N}}\right)(\hat{\omega}_k - \omega_k)$$

the error function yields $$X(\overline{\omega}; A) = \sum_{n=0}^{N-1}\left(x_n - \frac{1}{2} w_n \sum_{k=0}^{K-1}\left(A_k \exp\left(-2\pi i \hat{\omega}_k^{\frac{n-n_0}{N}}\right) + A_k^* \exp\left(2\pi i \hat{\omega}_k^{\frac{n-n_0}{N}}\right) + \left(-2\pi i^{\frac{n-n_0}{N}}\right)\left[A_k \exp\left(-2\pi i \hat{\omega}_k^{\frac{n-n_0}{N}}\right) + A_k^* \exp\left(2\pi i \hat{\omega}_k^{\frac{n-n_0}{N}}\right)\right](\hat{\omega}_k - \omega_k)\right)\right)^2$$

The least square error for this function is derived by equating all partial derivatives to zero $$\frac{\partial X(\overline{\omega}; A)}{\partial(\hat{\omega}_l - \omega_l)} = 0 \tag{33}$$

This results in $$H\Delta\omega = h \tag{34}$$

with $$\Delta\omega_l = \hat{\omega}_l - \omega_l \tag{35}$$

$$h_l = -\frac{2}{N}\Re\left(A_l \sum_{m=0}^{N-1} R_m W'(\hat{\omega}_l - m)\right)$$

$$H_{lk} = \Re\,(A_k A_l Y''(\hat{\omega}_k + \omega_l)) - \Re\,(A_k A_l^* Y''(\hat{\omega}_k - \omega_l))$$

One can observe that the right hand side of the equation is the gradient. For the system matrix H a similar structure is observed as for the matrix B which was used for the amplitude computation. Again, the bandlimited property of Y"(m) implies a band diagonal structure for H. This implies that also in this case the time complexity can be reduced by storing H as $\overleftarrow{H}$ $$\overleftarrow{H}_{lk} = H_{l,l+k-D} \tag{36}$$

and by computing $\Delta\overline{\omega}$ using $$\Delta\overline{\omega} = \mathrm{SOLVE}(\overleftarrow{H}, h) \tag{37}$$

Conclusion

Analogue to the system matrix B for the amplitude computation, the system matrix H for the computation of the optimization is also band diagonal. Again the set of equations can be solved in O(K) time.

4.3 Levenberg-Marquardt Optimization

When considering the system matrix H, used for Gauss-Newton optimization it is possible that it is poorly conditioned when the amplitudes axe very small. This can be solved by adding the unit matrix multiplied with a factor $\lambda$ which is called the regularization factor. Note that the regularized system matrix is still bandlimited and can still be computed in O(K) time. Using Eq. (35), the optimization can be written as $$\Delta\overline{\omega}(\lambda) = \mathrm{SOLVE}\left(\overleftarrow{H + \lambda I}, h\right) \tag{38}$$

Since the optimization step $\Delta\omega$ depends on $\lambda$ we write it in function of it.

The error function after iteration $^{(r)}$ is denoted by $\chi(\omega^{(r)}; A)$ and the optimization step of the frequencies that was achieved with regularization factor $\lambda^{(r)}$ as $\Delta\omega(\lambda^{(r)})$. The influence on the cost function for the next iteration is expressed by $$\chi(\omega^{(r)} + \Delta\omega(\lambda^{(r)}); A) \tag{39}$$

The value of $\lambda^{(r+1)}$ is adapted each iteration using $\lambda^{(r+1)}=\lambda^{(r)}$ and $\lambda^{(r+1)}=\lambda^{(r)}/\eta$. The choice between these updates is made by following rules;

1, If $\chi(\overline{\omega}^{(r)}+\Delta\overline{\omega}(\lambda^{(r)}/\eta); A)\leqq\chi(\overline{\omega}^{(r)}; A)$, then $\lambda^{(r+1)}=\lambda^{(r)}/\eta$ and $\overline{\omega}^{(r+1)}=\overline{\omega}^{(r)}+\Delta\overline{\omega}(\lambda^{(r)}/\eta)$.

2. If $\chi(\overline{\omega}^{(r)}+\Delta\overline{\omega}(\lambda^{(r)}/\eta); A)>\chi(\overline{\omega}^{(r)}; A)$, and $\chi(\overline{\omega}^{(r)}+\Delta\overline{\omega}(\lambda^{(r)}); A)\leqq\chi(\overline{\omega}^{(r)}; A)$, then $\lambda^{(r+1)}=\lambda^{(r)}$ and $\omega^{(r+1)}=\Delta\overline{\omega}^{(r)}+\Delta\overline{\omega}(\lambda^{(r)})$.

3. Finally, when both $\chi(\overline{\omega}^{(r)}+\Delta\overline{\omega}(\lambda^{(r)}/\eta); A)>\chi(\overline{\omega}^{(r)}; A)$, as $\chi(\overline{\omega}^{(r)}+\Delta\overline{\omega}(\lambda^{(r)}); A)>\chi(\overline{\omega}^{(r)}; A)$, then $\lambda^{(r)}$ is multiplied by $\eta$ until for a given q, $\chi(\overline{\omega}^{(r)}+\Delta\omega(\lambda^{(r)}\eta^q); A)\leqq\chi(\overline{\omega}^{(r)}; A)$. Subsequently, $\lambda^{(r+1)}=\lambda^{(r)}\eta^q$ and $\overline{\omega}^{(r+1)}=\overline{\omega}^{(r)}+\Delta\omega(\lambda^{(r)}\eta^q)$.

Conclusion

Since adding a regularization term to the diagonal elements does not affect the band diagonal structure of H, the O(K) complexity is maintained.

4.4 Newton Optimization

Another commonly known method is Newton optimization which makes a second order Taylor approximation of the error function around $\hat{\omega}$. The minimum of this approximation yields the optimized values and results for the model given in Eq. (29) in $$H\Delta\overline{\omega} = h \tag{40}$$

with $$\Delta\omega_l = \hat{\omega}_l - \omega_l \tag{41}$$

$$h_l = -\frac{2}{N}\Re\left(A_l\sum_{m=0}^{N-1} R_m W'(\hat{\omega}_l - m)\right)$$

$$H_{lk} = \Re\,(A_k A_l Y''(\hat{\omega}_k + \omega_l)) - \Re\,(A_k A_l^* Y''(\hat{\omega}_k - \omega_l)) - \delta_{kl}\frac{2}{N}\Re\left(A_l\sum_{m=0}^{N-1} R_m W''(\hat{\omega}_l - m)\right)$$

Note that the only difference between the system matrix H for Newton and Gauss-Newton optimization is the additional last term. This term can be computed in constant time by taking in account the bandlimited property of W"(m). Again, since this term only yields non zero values on the diagonal, the O(K) complexity is maintained. Also, this method can be combined with the regularization term that is used for Levenberg-Marquardt optimization.

Conclusion

The system matrix for Newton optimization is band diagonal and can be regularized when this is desired. The O(K) complexity is maintained.

4.5 Unifying the Optimization Methods

Gauss-Newton, Levenberg-Marquardt and Newton optimization can be written as a unified optimization procedure with two parameters $\lambda_1$ and $\lambda_2$ yielding $$\Delta\omega_l = \hat{\omega}_l - \omega_l \tag{42}$$

$$h_l = -\frac{2}{N}\Re\left(A_l\sum_{m=0}^{N-1} R_m W'(\hat{\omega}_l - m)\right)$$

$$H_{lk} = \Re\,(A_k A_l Y''(\hat{\omega}_k + \omega_l)) - \Re\,(A_k A_l^* Y''(\hat{\omega}_k - \omega_l)) - \lambda_1\delta_{kl}\frac{2}{N}\Re\left(A_l\sum_{m=0}^{N-1} R_m W''(\hat{\omega}_l - m)\right) + \delta_{kl}\lambda_2$$

Conclusion

Depending on the values $\lambda_1$ and $\lambda_2$ one can switch between different methods 1. If $\lambda_1=0$ and $\lambda_2=0$, Eq. (42) becomes Gauss-Newton optimization.

2. If $\lambda_1=1$ and $\lambda_2=0$, Eq. (42) becomes Newton optimization.

3. If $\lambda_1=0$ and $\lambda_2>0$, Eq. (42) becomes Levenberg-Marquardt optimization.

Figure 7:
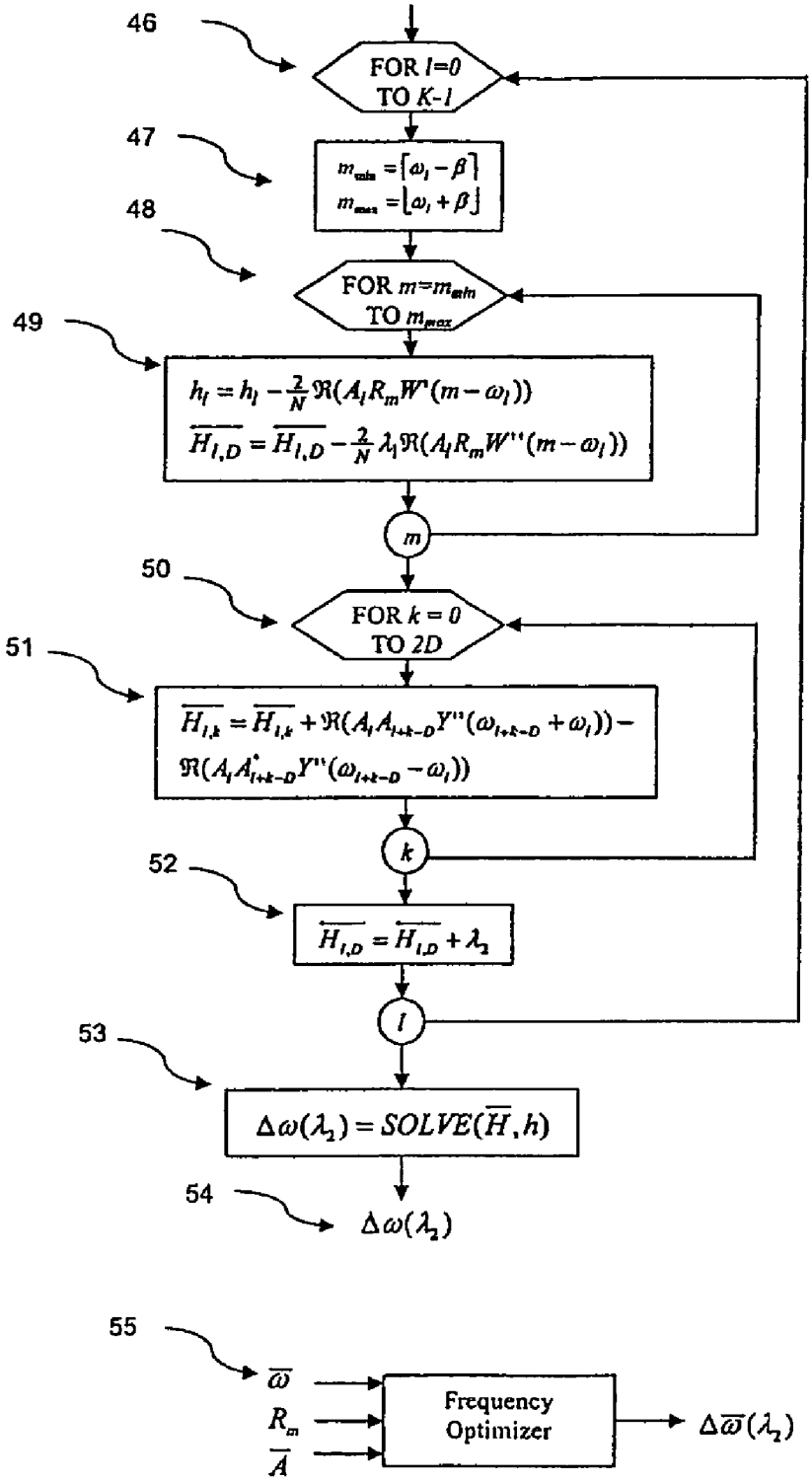
FIG. 7 depicts the frequency optimization for the stationary nonharmonic model.

For each of these algorithms the band diagonal structure of the system matrix can be exploited. The algorithm for the frequency optimization step is illustrated by FIG. 7.

A preferred embodiment of the method according to the invention, comprises the step of optimizing the frequencies for the stationary nonharmonic model by solving the equation given in Eq. (34), using Eq. (42) such that only elements around the diagonal of H are taken into account, whereby a shifted form $\overline{\mathbf{H}}$ is computed containing only the D diagonal bands according to Eq. (36) and Eq. (42), whereby the gradient h is computed from the residual spectrum $R_m$, amplitude $A_l$ and frequency $w_k$ and requires the computation of the derivative of the frequency response of the window W'(m), whereby the first term of H requires the computation of the second derivative of the frequency response of the square window denoted Y"(m), whereby the second term of H is computed from the residual spectrum $R_m$, amplitude $A_l$ and frequencies $\overline{\omega}$ and requires the computation of the second derivative of the frequency response W"(m), whereby the parameter $\lambda_1$ allows to switch between different optimization methods and the parameter $\lambda_2$ regularizes the system matrix, and computing the optimization step by solving the system of equations directly on $\overline{\mathbf{H}}$ and h according to Eq. (37) by an adapted gaussian elimination procedure. This method reduces the time complexity from $O(K^2N)$ to O(N log N).

5. Frequency Optimization for the Stationary Harmonic Model

In the case that all sound sources produce quasi-periodic signals, a model can be used that takes into account this relationship between the partials, yielding $$\tilde{x}_n = w_n\frac{1}{2}\sum_{k=0}^{S-1}\sum_{q=0}^{S_k-1}\left(A_{k,q}\exp\left(-2\pi i q\omega_k^{\frac{n-n_0}{N}}\right) + A_{k,q}^*\exp\left(2\pi i q\omega_k^{\frac{n-n_0}{N}}\right)\right) \tag{43}$$

The model consists of S sources each modelled by $S_k$ harmonic components. For this model, only the fundamental frequencies are optimized. The amplitude estimation is computed by the method disclosed in section 2, however care must be taken that different components with very close frequencies are eliminated. The computation of the optimization of the frequencies takes place in an analogue manner as for the independent sinusoids.

5.1 Gradient Based Methods

The gradient for the harmonic model yields $$h_l = \frac{\partial \chi(\overline{\omega}; \overline{A})}{\partial \omega_l} = -\frac{2}{N}\sum_{q=1}^{S_l-1} \Re\left(\sum_{m=0}^{N-1} R_m q A_{l,q} W'(q\omega_l - m)\right) \tag{44}$$

5.2 Gauss-Newton Optimization

The system matrix for Gauss-Newton optimization results in $$H_{lk} = \sum_{q=1}^{S_k-1}\sum_{r=1}^{S_l-1} qr[\Re(A_{k,q}A_{l,r}Y''(q\omega_k + r\omega_l)) - \Re(A_{k,q}A^*_{l,r}Y''(q\omega_k - r\omega_l))] \tag{45}$$

In this case, the matrix is not band diagonal and the optimization step is computed by solving $$H\Delta\omega = h \tag{46}$$

For a given value q, and a given frequency response bandwidth β, only the r values must be considered for which $r\omega_l$ falls in the main lobe. Since $$0 \le q\omega_p \le \frac{N}{2}$$

$$0 \le r\omega_l \le \frac{N}{2}$$

the input values of Y" are bounded by $$-\frac{N}{2} \le q\omega_p - r\omega_l \le \frac{N}{2}$$

$$0 \le q\omega_p + r\omega_l \le N$$

This implies that the main lobe of $Y(q\omega_p - r\omega_l)$ ranges from −β to β. For $Y(q\omega_p + r\omega_l)$ the main lobe is divided over the left and right side of the spectrum due to spectral replication yielding the intervals [0, β] and [N−β,N]. This implies that for $Y(q\omega_p - r\omega_l)$ only the r values must be considered for which $$-\beta \le q\omega_p - r\omega_l \le \beta$$

$$\Rightarrow \frac{q\omega_p - \beta}{\omega_l} \le r \le \frac{q\omega_p + \beta}{\omega_l}$$

The two intervals for $Y(q\omega_p + r\omega_l)$ yield $$0 \le q\omega_p + r\omega_l \le \beta$$

$$\Rightarrow \frac{-q\omega_p}{\omega_l} \le r \le \frac{\beta - q\omega_p}{\omega_l}$$

-continued and $$N - \beta \le q\omega_p + r\omega_l \le N$$

$$\Rightarrow \frac{N - \beta - q\omega_p}{\omega_l} \le r \le \frac{N - q\omega_p}{\omega_l}$$

This results finally in $$H_{l,k} = \sum_{q=1}^{S-1}\left[\sum_{r=1}^{r_{max,1}} qr\Re(A_{p,q}A_{l,r}Y''(q\omega_p + r\omega_l)) + \sum_{r=r_{min,2}}^{r_{max,2}} qr\Re(A_{p,q}A_{l,r}Y''(q\omega_p + r\omega_l)) - \sum_{r=r_{min,3}}^{r_{max,3}} qr\Re(A_{p,q}A^*_{l,r}Y''(q\omega_p - r\omega_l))\right]$$

with $$r_{max,1} = \left\lfloor \frac{\beta - q\omega_p}{\omega_l} \right\rfloor$$

$$r_{min,2} = \left\lceil \frac{N - \beta - q\omega_p}{\omega_l} \right\rceil$$

$$r_{max,2} = \left\lfloor \frac{N - q\omega_p}{\omega_l} \right\rfloor$$

$$r_{min,3} = \left\lceil \frac{q\omega_p - \beta}{\omega_l} \right\rceil$$

$$r_{max,3} = \left\lfloor \frac{q\omega_p + \beta}{\omega_l} \right\rfloor$$

5.3 Levenberg-Marquardt Optimization

Analogue as for the non harmonic model, the system matrix can be ill-conditioned in the case of very weak components. When this occurs, one can add the unity matrix I multiplied with a regularization factor λ. This value can be updated as described in section 3.3.

5.4 Newton Optimization

Also for the harmonic model, the system matrix for Gauss-Newton and Newton optimization are very similar. Only to the diagonal band, an additional term must be added yielding $$-\delta_{lp}\frac{2}{N}\Re\left(\sum_{q=1}^{S_l-1}\sum_{m=0}^{N-1} R_m q^2 A_{p,q} W''(q\omega_p - m)\right) \tag{47}$$

5.5 Unifying the Frequency Optimization Methods for the Harmonic Model

The proposed optimization methods can be unified in one set of equations using two parameters $\lambda_1$ and $\lambda_2$ yielding $$H\Delta\omega = h \tag{48}$$

with $$\Delta\omega_l = \hat{\omega}_l - \omega_l \tag{49}$$

-continued $$h_l = -\frac{2}{N}\sum_{q=1}^{S_l-1}\Re\left(\sum_{m=0}^{N-1} R_m q A_{l,q} W'(q\omega_l - m)\right)$$

$$H_{l,k} = \sum_{q=1}^{S-1}\left[\sum_{r=1}^{r_{max,1}} qr\Re\left(A_{p,q}A_{l,r}Y''(q\omega_p + r\omega_l) + \sum_{r=r_{min,2}}^{r_{max,2}} qr\Re\left(A_{p,q}A_{l,r}Y''(q\omega_p + r\omega_l) - \sum_{r=r_{min,3}}^{r_{max,3}} qr\Re(A_{p,q}A^*_{l,r}Y''(q\omega_p - r\omega_l)] - \lambda_1\delta_{lp}\frac{2}{N}\Re\left(\sum_{q=1}^{S_l-1}\sum_{m=0}^{N-1} R_m q^2 A_{p,q} W''(q\omega_p - m)\right) + \delta_{lp}\lambda_2\right.\right.$$

Conclusion

Depending on the values $\lambda_1$ and $\lambda_2$ one obtains

1. If $\lambda_1=0$ and $\lambda_2=0$, Eq. (49) becomes Gauss-Newton optimization.
2. If $\lambda_1=1$ and $\lambda_2=0$, Eq. (49) becomes Newton optimization.
3. If $\lambda_1=0$ and $\lambda_2>0$, Eq. (49) becomes Levenberg-Marquardt optimization.

Figure 8:
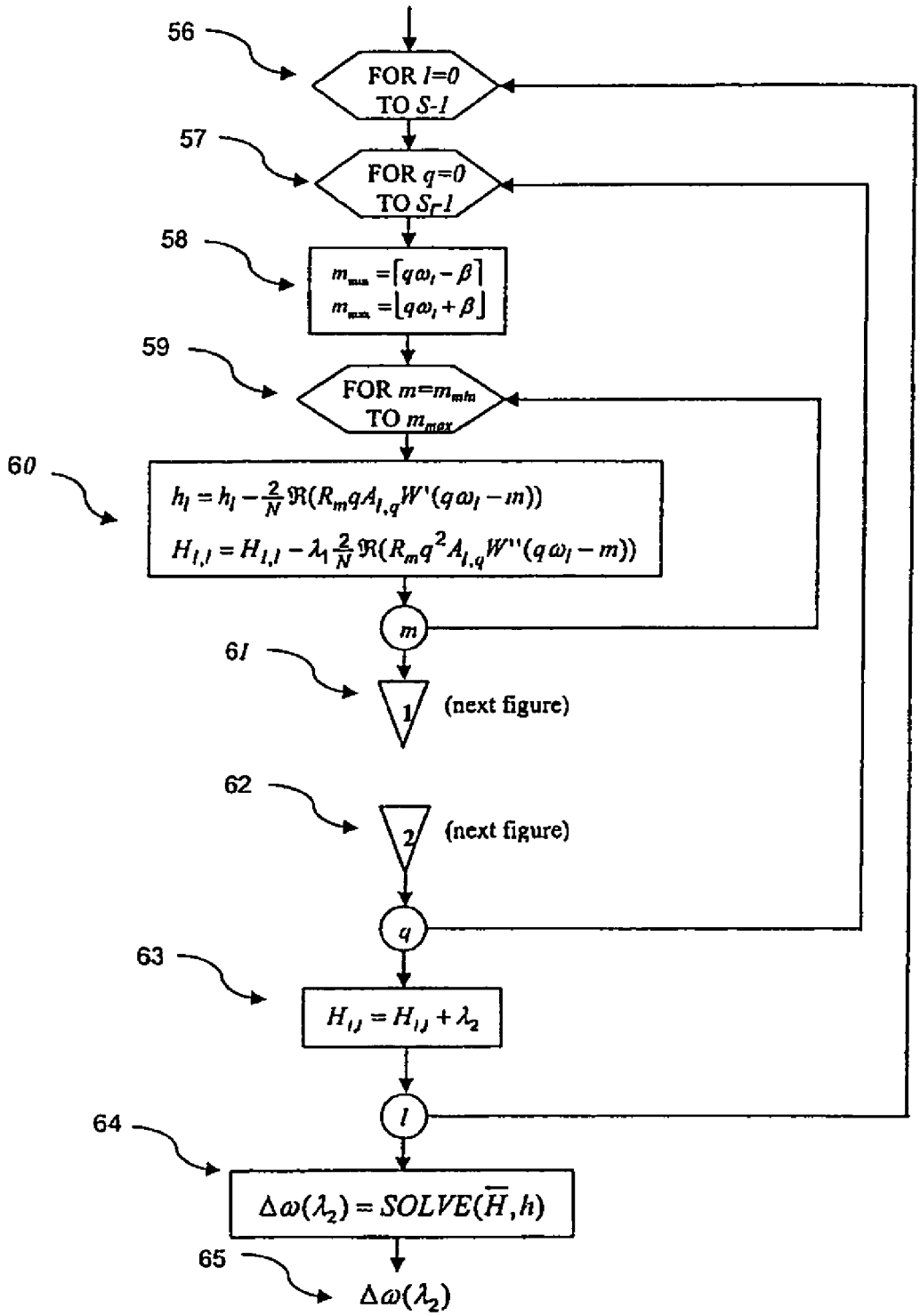
FIG. 8 depicts the frequency optimization for the stationary harmonic model.
Figure 9:
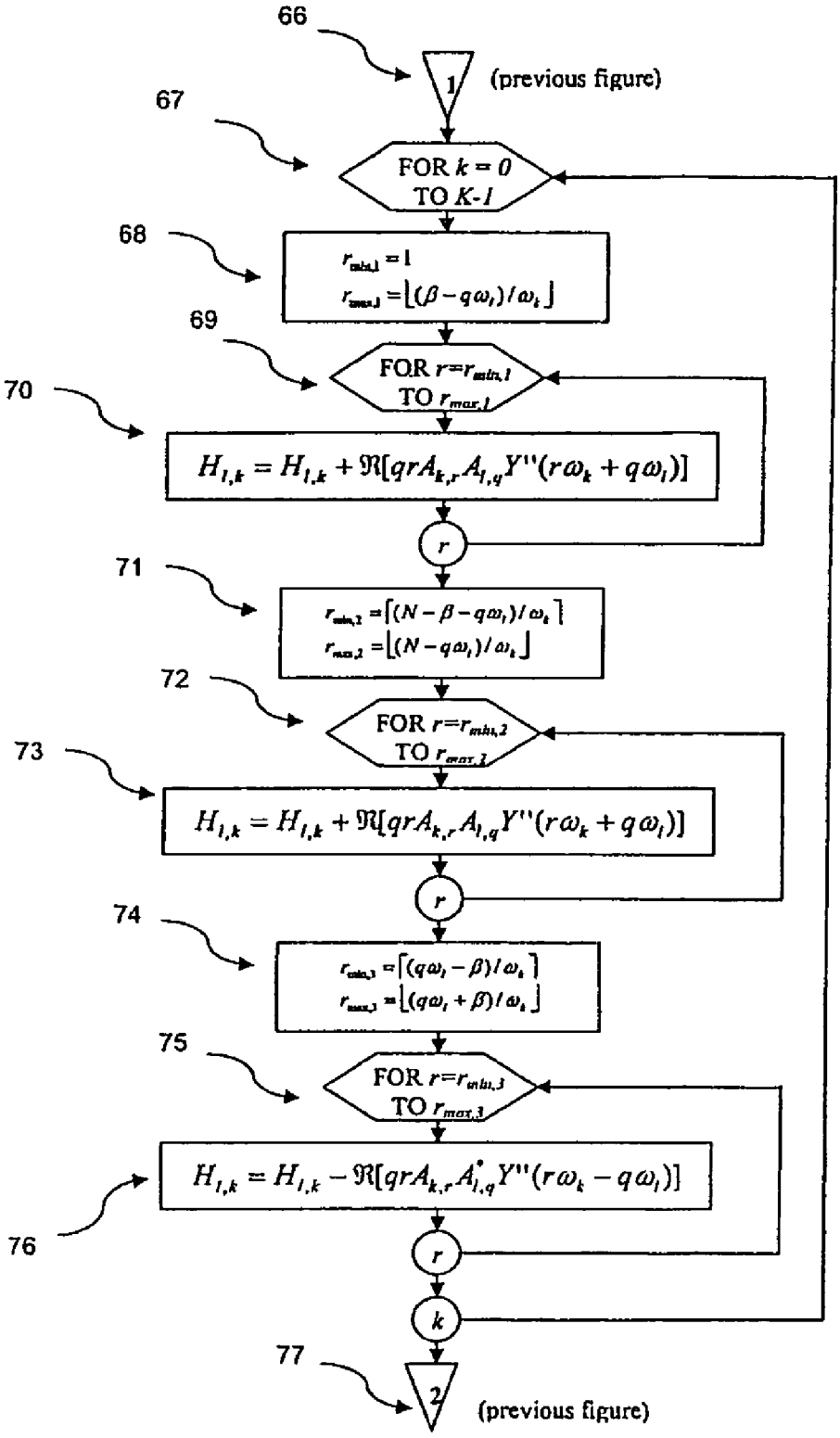
FIG. 9 depicts a subroutine of the frequency optimization for the stationary harmonic model.

The algorithm for the frequency optimization step is illustrated by FIGS. 8 and 9.

A preferred embodiment of the method according to the invention, comprises the optimization the frequencies for the harmonic signal model, by computing the optimization step solving Eq. (48) using Eq. (49), whereby the gradient h is computed from the residual spectrum $R_m$ amplitude $A_l$ and frequencies $\overline{\omega}$, and requires the computation of derivative of the frequency response of the window W'(m), whereby the first term of H requires the computation of the second derivative of the frequency response of the square window denoted Y"(m), whereby the second term of H is computed from the residual spectrum $R_m$, amplitude $A_l$ and frequencies $w_k$, and requires the computation of the second derivative of the frequency response W"(m), whereby the parameter $\lambda_1$ allows to switch. between different optimization methods and the parameter $\lambda_2$ regularizes the system matrix.

6. Sinusoidal Modeling with Nonstationary Components

6.1 The Model

In many applications it is interesting to study the nonstationary behavior of the amplitudes and phases. Therefore, complex polynomial amplitudes of order P are proposed. For a model with K sinusoidal components this results in $$\tilde{x}_n = w_n\frac{1}{2}\sum_{k=0}^{K-1}\sum_{p=0}^{P-1}\left[A_{kp}\left(-2\pi i\frac{n-n_0}{N}\right)^p\exp\left(-2\pi i\omega_k\frac{n-n_0}{N}\right) + A^*_{kp}\left(2\pi i\frac{n-n_0}{N}\right)^p\exp\left(2\pi i\omega_k\frac{n-n_0}{N}\right)\right] \tag{50}$$

This can be reformulated as $$\tilde{x}_n = w_n\frac{1}{2}\sum_{k=0}^{K-1}\sum_{p=0}^{P-1}A^r_{k,p}\left[(-2\pi i^{\frac{n-n_0}{N}})^p\exp\left(-2\pi\omega_k^{\frac{n-n_0}{N}}\right) + (2\pi i^{\frac{n-n_0}{N}})^p\exp\left(2\pi\omega_k^{\frac{n-n_0}{N}}\right)\right] + iA^i_{k,p}\left[(-2\pi i^{\frac{n-n_0}{N}})^p\exp\left(-2\pi\omega_k^{\frac{n-n_0}{N}}\right) - (2\pi i^{\frac{n-n_0}{N}})^p\exp\left(2\pi\omega_k^{\frac{n-n_0}{N}}\right)\right] \tag{51}$$

6.2 Complex Polynomial Amplitude Computation

The square difference between the signal and the model is written as $$\sum_{n=0}^{N-1}\left(x_n - w_n\frac{1}{2}\sum_{k=0}^{K-1}\sum_{p=0}^{P-1}A^r_{k,p}\left[\begin{array}{c}(-2\pi i^{\frac{n-n_0}{N}})^p\exp\left(-2\pi i\omega_k^{\frac{n-n_0}{N}}\right) + \\ (2\pi i^{\frac{n-n_0}{N}})^p\exp\left(2\pi i\omega_k^{\frac{n-n_0}{N}}\right)\end{array}\right] + iA^i_{k,p}\left[\begin{array}{c}(-2\pi i^{\frac{n-n_0}{N}})^p\exp\left(-2\pi i\omega_k^{\frac{n-n_0}{N}}\right) - \\ (2\pi i^{\frac{n-n_0}{N}})^p\exp\left(2\pi i\omega_k^{\frac{n-n_0}{N}}\right)\end{array}\right]\right)^2 \tag{52}$$

The amplitudes are computed by taking all partial derivatives with respect to $A_{l,q}^{\ r}$ and $A_{l,q}^{\ i}$ and equate this expressions to zero yielding $$\sum_{n=0}^{N-1}\left(x_n - w_n\frac{1}{2}\sum_{k=0}^{K-1}\sum_{p=0}^{P-1}A^r_{k,p}\left[\left(-2\pi i^{\frac{n-n_0}{N}}\right)^p\exp\left(-2\pi i\omega_k^{\frac{n-n_0}{N}}\right) + \left(2\pi i^{\frac{n-n_0}{N}}\right)^p\exp\left(2\pi i\omega_k^{\frac{n-n_0}{N}}\right)\right] + iA^i_{k,p}\left[\left(-2\pi i^{\frac{n-n_0}{N}}\right)^p\exp\left(-2\pi i\omega_k^{\frac{n-n_0}{N}}\right) - \left(2\pi i^{\frac{n-n_0}{N}}\right)^p\exp\left(2\pi i\omega_k^{\frac{n-n_0}{N}}\right)\right]\right)\left(-w_n\frac{1}{2}\left[\left(-2\pi i^{\frac{n-n_0}{N}}\right)^q\exp\left(-2\pi i\omega_l^{\frac{n-n_0}{N}}\right) + \left(2\pi i^{\frac{n-n_0}{N}}\right)^q\exp\left(2\pi i\omega_l^{\frac{n-n_0}{N}}\right)\right]\right) = 0 \tag{53}$$

and $$\sum_{n=0}^{N-1}\left(x_n - w_n\frac{1}{2}\sum_{k=0}^{K-1}\sum_{p=0}^{P-1}A^r_{k,p}\left[\left(-2\pi i^{\frac{n-n_0}{N}}\right)^p\exp\left(-2\pi i\omega_k^{\frac{n-n_0}{N}}\right) + \left(2\pi i^{\frac{n-n_0}{N}}\right)^p\exp\left(2\pi i\omega_k^{\frac{n-n_0}{N}}\right)\right] + iA^i_{k,p}\left[\left(-2\pi i^{\frac{n-n_0}{N}}\right)^p\exp\left(-2\pi i\omega_k^{\frac{n-n_0}{N}}\right) - \left(2\pi i^{\frac{n-n_0}{N}}\right)^p\exp\left(2\pi i\omega_k^{\frac{n-n_0}{N}}\right)\right]\right)\left(-iw_n\frac{1}{2}\left[\left(-2\pi i^{\frac{n-n_0}{N}}\right)^q\exp\left(-2\pi i\omega_l^{\frac{n-n_0}{N}}\right) - \left(2\pi i^{\frac{n-n_0}{N}}\right)^q\exp\left(2\pi i\omega_l^{\frac{n-n_0}{N}}\right)\right]\right) = 0 \tag{54}$$

This results in 2KP equations which allow to determine the 2KP unknowns.

As a result, the system matrix has a size 2KP×2KP. Analogue to the system matrix for the amplitude computation B, the system matrix can be divided in four quadrants denoted $B^{1,1}$, $B^{1,2}$, $B^{2,1}$ and $B^{2,2}$ yielding $$\begin{bmatrix} B^{1,1} & B^{1,2} \\ B^{2,1} & B^{2,2} \end{bmatrix} \begin{bmatrix} A^1 \\ A^2 \end{bmatrix} = \begin{bmatrix} C^1 \\ C^2 \end{bmatrix} \tag{55}$$

with $$\begin{aligned}
B^{1,1}_{qK+l,pK+k} &= \frac{1}{4}\sum_{n=0}^{N-1} w_n^2\Big[\big(-2\pi i^{\frac{n-n_0}{N}}\big)^p \exp\big(-2\pi i\omega_k^{\frac{n-n_0}{N}}\big) + \\
&\quad \big(2\pi i^{\frac{n-n_0}{N}}\big)^p \exp\big(2\pi i\omega_k^{\frac{n-n_0}{N}}\big)\Big] \\
&\quad \Big[\big(-2\pi i^{\frac{n-n_0}{N}}\big)^q \exp\big(-2\pi i\omega_l^{\frac{n-n_0}{N}}\big) + \\
&\quad \big(2\pi i^{\frac{n-n_0}{N}}\big)^q \exp\big(2\pi i\omega_l^{\frac{n-n_0}{N}}\big)\Big] \\
B^{1,2}_{qK+l,pK+k} &= \frac{i}{4}\sum_{n=0}^{N-1} w_n^2\Big[\big(-2\pi i^{\frac{n-n_0}{N}}\big)^p \exp\big(-2\pi i\omega_k^{\frac{n-n_0}{N}}\big) - \\
&\quad \big(2\pi i^{\frac{n-n_0}{N}}\big)^p \exp\big(2\pi i\omega_k^{\frac{n-n_0}{N}}\big)\Big] \\
&\quad \Big[\big(-2\pi i^{\frac{n-n_0}{N}}\big)^q \exp\big(-2\pi i\omega_l^{\frac{n-n_0}{N}}\big) + \\
&\quad \big(2\pi i^{\frac{n-n_0}{N}}\big)^q \exp\big(2\pi i\omega_l^{\frac{n-n_0}{N}}\big)\Big] \\
B^{2,1}_{qK+l,pK+k} &= \frac{i}{4}\sum_{n=0}^{N-1} w_n^2\Big[\big(-2\pi i^{\frac{n-n_0}{N}}\big)^p \exp\big(-2\pi i\omega_k^{\frac{n-n_0}{N}}\big) + \\
&\quad \big(2\pi i^{\frac{n-n_0}{N}}\big)^p \exp\big(2\pi i\omega_k^{\frac{n-n_0}{N}}\big)\Big] \\
&\quad \Big[\big(-2\pi i^{\frac{n-n_0}{N}}\big)^q \exp\big(-2\pi i\omega_l^{\frac{n-n_0}{N}}\big) - \\
&\quad \big(2\pi i^{\frac{n-n_0}{N}}\big)^q \exp\big(2\pi i\omega_l^{\frac{n-n_0}{N}}\big)\Big] \\
B^{2,2}_{qK+l,pK+k} &= -\frac{1}{4}\sum_{n=0}^{N-1} w_n^2\Big[\big(-2\pi i^{\frac{n-n_0}{N}}\big)^p \exp\big(-2\pi i\omega_k^{\frac{n-n_0}{N}}\big) - \\
&\quad \big(2\pi i^{\frac{n-n_0}{N}}\big)^p \exp\big(2\pi i\omega_k^{\frac{n-n_0}{N}}\big)\Big] \\
&\quad \Big[\big(-2\pi i^{\frac{n-n_0}{N}}\big)^q \exp\big(-2\pi i\omega_l^{\frac{n-n_0}{N}}\big) - \\
&\quad \big(2\pi i^{\frac{n-n_0}{N}}\big)^q \exp\big(2\pi i\omega_l^{\frac{n-n_0}{N}}\big)\Big] \\
C^1_{qK+l} &= \sum_{n=0}^{N-1} x_n w_n \frac{1}{2}\Big[\big(-2\pi i^{\frac{n-n_0}{N}}\big)^q \exp\big(-2\pi\omega_l^{\frac{n-n_0}{N}}\big) + \\
&\quad \big(2\pi i^{\frac{n-n_0}{N}}\big)^q \exp\big(2\pi\omega_l^{\frac{n-n_0}{N}}\big)\Big] \\
C^2_{qK+l} &= i\sum_{n=0}^{N-1} x_n w_n \frac{1}{2}\Big[\big(-2\pi i^{\frac{n-n_0}{N}}\big)^q \exp\big(-2\pi\omega_l^{\frac{n-n_0}{N}}\big) - \\
&\quad \big(2\pi i^{\frac{n-n_0}{N}}\big)^q \exp\big(2\pi\omega_l^{\frac{n-n_0}{N}}\big)\Big] \\
A^1_{pK+k} &= A^r_{k,p} \\
A^2_{pK+k} &= A^i_{k,p}
\end{aligned} \tag{56}$$

The real and imaginary part of the frequency response and its derivatives can be expressed using $$\begin{aligned}
\Re[Y(m)] &= \frac{1}{2}\sum_{n=0}^{N-1} w_n^2 \exp\big(2\pi i^{\frac{n-n_0}{N}}\big) + \\
&\quad \frac{1}{2}\sum_{n=0}^{N-1} w_n^2 \exp\big(-2\pi i m^{\frac{n-n_0}{N}}\big) \\
\Rightarrow \frac{\partial^p}{\partial m^p}\Re[Y(m)] &= \frac{1}{2}\sum_{n=0}^{N-1} w_n^2\big(2\pi i^{\frac{n-n_0}{N}}\big)^p \exp\big(2\pi i m^{\frac{n-n_0}{N}}\big) + \\
&\quad \frac{1}{2}\sum_{n=0}^{N-1} w_n^2\big(-2\pi i^{\frac{n-n_0}{N}}\big)^p \exp\big(-2\pi i m^{\frac{n-n_0}{N}}\big)
\end{aligned} \tag{57}$$

$$\begin{aligned}
\Im[Y(m)] &= \frac{1}{2i}\sum_{n=0}^{N-1} w_n^2 \exp\big(2\pi i m^{\frac{n-n_0}{N}}\big) - \\
&\quad \frac{1}{2i}\sum_{n=0}^{N-1} w_n^2 \exp\big(-2\pi i m^{\frac{n-n_0}{N}}\big) \\
\Rightarrow \frac{\partial^p}{\partial m^p}\Im[Y(m)] &= \frac{1}{2i}\sum_{n=0}^{N-1} w_n^2\big(2\pi i^{\frac{n-n_0}{N}}\big)^p \exp\big(2\pi i m^{\frac{n-n_0}{N}}\big) - \\
&\quad \frac{1}{2i}\sum_{n=0}^{N-1} w_n^2\big(-2\pi i^{\frac{n-n_0}{N}}\big)^p \exp\big(-2\pi i m^{\frac{n-n_0}{N}}\big)
\end{aligned} \tag{58}$$

from which follows that the expressions of Eq. (56) can be transformed to $$\begin{aligned}
B^{1,1}_{qK+l,pK+p} &= \frac{1}{2}\left[\frac{\partial^{p+q}}{\partial m^{p+q}}\Re[Y(m)]\right]_{m=\omega_k+\omega_k} + \\
&\quad (-1)^{-q}\frac{1}{2}\left[\frac{\partial^{p+q}}{\partial m^{p+q}}\Re[Y(m)]\right]_{m=\omega_k-\omega_k} \\
B^{1,2}_{qK+l,pK+p} &= -\frac{1}{2}\left[\frac{\partial^{p+q}}{\partial m^{p+q}}\Im[Y(m)]\right]_{m=\omega_k+\omega_k} - \\
&\quad (-1)^{q}\frac{1}{2}\left[\frac{\partial^{p+q}}{\partial m^{p+q}}\Im[Y(m)]\right]_{m=\omega_k-\omega_k} \\
B^{2,1}_{qK+l,pK+p} &= -\frac{1}{2}\left[\frac{\partial^{p+q}}{\partial m^{p+q}}\Im[Y(m)]\right]_{m=\omega_k+\omega_k} + \\
&\quad (-1)^{q}\frac{1}{2}\left[\frac{\partial^{p+q}}{\partial m^{p+q}}\Im[Y(m)]\right]_{m=\omega_k-\omega_k} \\
B^{2,2}_{qK+l,pK+p} &= -\frac{1}{2}\left[\frac{\partial^{p+q}}{\partial m^{p+q}}\Re[Y(m)]\right]_{m=\omega_k+\omega_k} + \\
&\quad (-1)^{-q}\frac{1}{2}\left[\frac{\partial^{p+q}}{\partial m^{p+q}}\Re[Y(m)]\right]_{m=\omega_k-\omega_k} \\
C^1_{qK+l} &= \Re\left(\frac{1}{N}\sum_{m=0}^{N-1} X_m \frac{\partial^q}{\partial m^q} W(m+\omega_l)\right) \\
C^2_{qK+l} &= -\Im\left(\frac{1}{N}\sum_{m=0}^{N-1} X_m \frac{\partial^q}{\partial m^q} W(m+\omega_l)\right) \\
A^1_{pK+k} &= A^r_{k,p} \\
A^2_{pK+k} &= A^i_{k,p}
\end{aligned} \tag{59}$$

Figure 10:
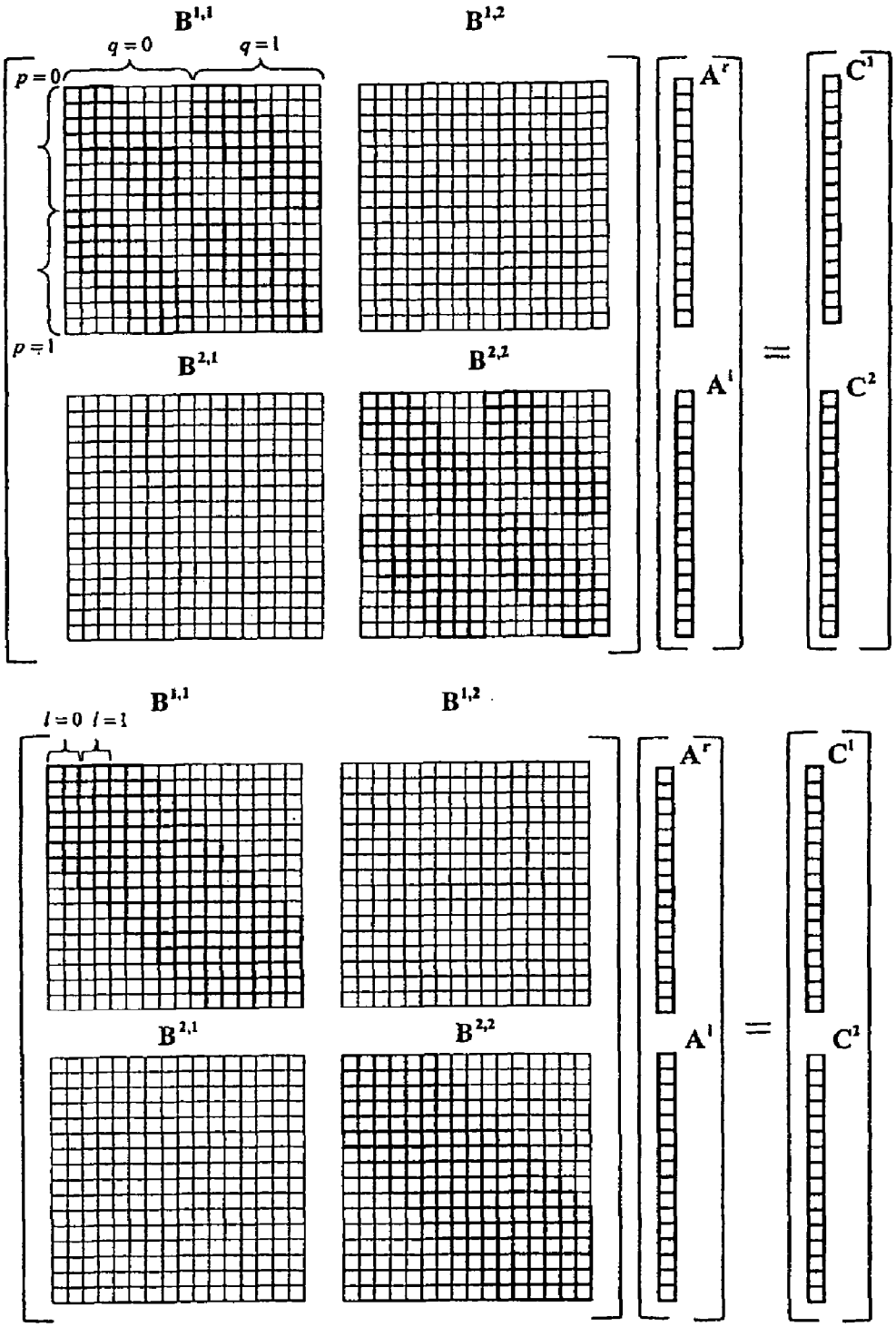
FIG. 10 illustrates the band diagonal property of the system matrix B for the computation of the complex polynomial amplitudes.

The vectors C and matrices B are now expressed in terms of the frequency response of the windows and the square window respectively. Each (p,q)-couple denotes a submatrix of the matrices of size K×K. From the bandlimited property of $\Re[Y(m)]$ and its derivatives follows that these submatrices of $B^{1,1}$ and $B^{2,2}$ are band diagonal. In an analogue manner, since $\Im[Y(m)]$ and its derivatives always yield zero, the submatrices $B^{1,2}$ and $B^{2,1}$ contain only zeros. This structure is depicted at the top of FIG. 10.

The upper left and lower right kwadrants contain band diagonal submatrices for each (p,q)-couple. This implies that all relevant values are stored at positions defined by a quadruple (l,q,k,p) for which the following conditions hold:

$$-D \leqq k-l \leqq D$$
$$0 \leqq p < P-1$$
$$0 \leqq q \leqq P-1 \tag{60}$$

The inequalities given in Eq. (60) can be transformed to $$-DP \leqq (k-l)P \leqq DP$$
$$0 \leqq p \leqq P-1$$
$$-(P-1) \leqq -q \leqq 0 \tag{61}$$

from which follows that $$-(D+1)P+1 \leqq (kP+p)-(lP+q) \leqq (D+1)P-1 \tag{62}$$

By inverting the indexation order, i.e. using (kP+p,lP+q) instead of (pK+k,qK+l), one obtains for the row index kP+p and for the column index lP+q. Since their difference denotes the index of the diagonal, it follows from Eq. (62) that all relevant values lie around the main diagonal. This is illustrated by the lower part of FIG. 10. A a result, the definition of the system of equations after inversion of the indexation becomes $$\begin{aligned}
B^{1,1}_{lP+q,kP+p} &= \frac{1}{2}\left[\frac{\partial^{p+q}}{\partial m^{p+q}}\Re[Y(m)]\right]_{m=\omega_k+\omega_k} + (-1)^{-q}\frac{1}{2}\left[\frac{\partial^{p+q}}{\partial m^{p+q}}\Re[Y(m)]\right]_{m=\omega_k-\omega_k} \\
B^{1,2}_{lP+q,kP+p} &= -\frac{1}{2}\left[\frac{\partial^{p+q}}{\partial m^{p+q}}\Im[Y(m)]\right]_{m=\omega_k+\omega_k} - (-1)^{q}\frac{1}{2}\left[\frac{\partial^{p+q}}{\partial m^{p+q}}\Im[Y(m)]\right]_{m=\omega_k-\omega_k} \\
B^{2,1}_{lP+q,kP+p} &= -\frac{1}{2}\left[\frac{\partial^{p+q}}{\partial m^{p+q}}\Im[Y(m)]\right]_{m=\omega_k+\omega_k} + (-1)^{q}\frac{1}{2}\left[\frac{\partial^{p+q}}{\partial m^{p+q}}\Im[Y(m)]\right]_{m=\omega_k-\omega_k} \\
B^{2,2}_{lP+q,kP+p} &= -\frac{1}{2}\left[\frac{\partial^{p+q}}{\partial m^{p+q}}\Re[Y(m)]\right]_{m=\omega_k+\omega_k} + (-1)^{-q}\frac{1}{2}\left[\frac{\partial^{p+q}}{\partial m^{p+q}}\Re[Y(m)]\right]_{m=\omega_k-w_k} \\
C^{1}_{lP+q} &= \Re\left(\frac{1}{N}\sum_{m=0}^{N-1} X_m \frac{\partial^q}{\partial m^q} W(m+\omega_l)\right) \\
C^{2}_{lP+q} &= -\Im\left(\frac{1}{N}\sum_{m=0}^{N-1} X_m \frac{\partial^q}{\partial m^q} W(m+\omega_l)\right) \\
A^{1}_{kP+p} &= A^{r}_{k,p} \\
A^{2}_{kP+p} &= A^{i}_{k,p}
\end{aligned} \tag{63}$$

By using a look-up table for each derivative of the frequency response each element can be computed in constant time. Since $B^{1,1}$ and $B^{2,2}$ are band diagonal they can be stored in a more compact form containing only the relevant diagonal bands, yielding $$\begin{aligned}
B^{1,1}_{lP+q,kP+p} &= B^{1,1}_{lP+q,lP+q+kP+p-(D+1)P+1} = B^{1,1}_{lP+q,(k+l-D)P+(p+q-P+1)} \\
B^{2,2}_{lP+q,kP+p} &= B^{2,2}_{lP+q,lP+q+kP+p-(D+1)P+1} = B^{2,2}_{lP+q,(k+l-D)P+(p+q-P+1)}
\end{aligned} \tag{64}$$

with p and q ranging from 0 to P−1, l ranging from 0 to K−1, and k from 0 to 2D.

Conclusion

A least squares method is derived which allows to analyse non stationary sinusoidal components defined by Eq. (50). This model for a windowed signal of length N, consists of K sinusoidal components with complex polynomial component of order P. When the equations are solved in the time domain the computation of the system matrix has a complexity $O((KP)^2N)$ and solving the equations a complexity $O((KP)^3)$. By using the band diagonal property of the submatrices and rearranging the index so that all relevant values lie close to the main diagonal the complexity can be reduced to $O(KP(DP)^2)$. Generally, the order of the polynomial and the number of diagonal bands is quite small relative to the number of components K and number of samples N.

A preferred embodiment of the method according to the invention comprises the step of computing the polynomial complex amplitudes by solving the equation given in Eq. (55), using Eq. (56) such that only the elements around the diagonal of B are taken into account, whereby a shifted form $\overleftarrow{B}$ is computed containing only PD diagonal bands of B according to Eq. (64) and Eq. (56), whereby the computation is required of the frequency response of the square window and its derivatives $$\frac{\partial^p}{\partial m^p} Y(m),$$

whereby the computation is required of the frequency response of the window and its derivatives $$\frac{\partial^p}{\partial m^p} W(m),$$

and solving the equation given by Eq. (55) directly from $\overleftarrow{B}$ and C by an adapted gaussian elimination procedure. This method reduced the complexity from $O((KP)^3)$ to $O(KP(DP)^2)$.

6.3 Model Interpretation

The fact that amplitudes are complex polynomials makes them awkward to interpret. It is more convenient to interpret the sinusoidal model in terms of instantaneous amplitudes, phases and frequencies. Therefore, the model given by Eq. (50), is written as $$\tilde{x}_n = w_n \Re\left[\sum_{k=0}^{K-1} A_{kp}\left(-2\pi i \frac{n-n_0}{N}\right)^p \exp\left(-2\pi i \omega_k \frac{n-n_0}{N}\right)\right] \tag{65}$$

and reformulated using $$\hat{A}_{k,p}=A_{k,p}i^p \tag{66}$$

resulting in $$\tilde{x}_n = w_n \Re\left[\sum_{k=0}^{K-1} \hat{A}_{kp}\left(-2\pi^{\frac{n-n_0}{N}}\right)^p \exp\left(-2\pi i\omega_k^{\frac{n-n_0}{N}}\right)\right] \tag{67}$$

This equation can now be written as $$\tilde{x}_n = w_n \Re\left[\sum_{k=0}^{K-1} \Psi_k(n)\exp(\Phi_k(n))\right] \tag{68}$$

with $$\Psi_k(n) = \sqrt{\left(\sum_{p=0}^{P-1} \hat{A}_{k,p}^r\left(-2\pi^{\frac{n-n_0}{N}}\right)^p\right)^2 + \left(\sum_{p=0}^{P-1} \hat{A}_{k,p}^i\left(-2\pi i^{\frac{n-n_0}{N}}\right)^p\right)^2}$$

$$\Phi_k(n) = 2i\omega_k^{\frac{n-n_0}{N}} + i\arctan\left(\frac{\sum_{p=0}^{P-1} \hat{A}_{k,p}^i\left(-2\pi^{\frac{n-n_0}{N}}\right)^p}{\sum_{p=0}^{P-1} \hat{A}_{k,p}^r\left(-2\pi i^{\frac{n-n_0}{N}}\right)^p}\right) \tag{69}$$

where $\Psi_k(n)$ and $\Phi_k(n)$ are called respectively the instantaneous amplitude and frequency of each partial k. To simplify the notation, $\alpha^r(n)$ and $\alpha^i(n)$ are defined as $$\alpha_k^r(n) \equiv \sum_{p=0}^{P-1} \hat{A}_{k,p}^r\left(-2\pi^{\frac{n-n_0}{N}}\right)^p \tag{70}$$

$$\alpha_k^i(n) \equiv \sum_{p=0}^{P-1} \hat{A}_{k,p}^i\left(-2\pi^{\frac{n-n_0}{N}}\right)^p$$

The instantaneous amplitudes, phases and their derivatives can now be written as $$\Psi_k(n) = \sqrt{\alpha_k^r(n)^2 + \alpha_k^i(n)^2}$$

$$\frac{\partial\Psi_k(n)}{\partial n} = \frac{\alpha_k^r(n)\alpha_k'^r(n) + \alpha_k^i(n)\alpha_k'^i(n)}{\sqrt{\alpha_k^r(n)^2 + \alpha_k^i(n)^2}}$$

$$\frac{\partial\Psi_k(n)}{\partial n^2} = \frac{1}{(\alpha_k^r(n)^2 + \alpha_k^i(n)^2)^{3/2}} ([\alpha_k'^r(n)^2 + \alpha_k^r(n)\alpha_k''^r(n) + \alpha_k'^i(n)^2 + \alpha_k^i(n)\alpha_k''^i(n)] [(\alpha_k^r(n)^2 + \alpha_k^i(n)^2] - [\alpha_k^r(n)\alpha_k'^r(n) + \alpha_k^i(n)\alpha_k'^i]^2)$$

$$\Phi_k(n) = 2\pi i\omega_k^{\frac{n-n_0}{N}} + i\arctan\left(\frac{\alpha_k^i(n)}{\alpha_k^r(n)}\right)$$

$$\frac{\partial\Phi_k(n)}{\partial n} = 2\pi i\omega_k + i\frac{\alpha_k^r(n)\alpha_k'^i(n) - \alpha_k^i(n)\alpha_k'^r(n)}{\alpha_k^r(n)^2 + \alpha_k^i(n)^2}$$

-continued $$\frac{\partial^2\Phi_k(n)}{\partial n^2} = i\frac{1}{(\alpha_k^r(n)^2 + \alpha_k^i(n)^2)^2} ([\alpha_k^r(n)\alpha_k''^i(n) - \alpha_k^i(n)\alpha_k''^r(n)] [\alpha_k^r(n)^2 + \alpha_k^i(n)^2] + 2[\alpha_k^r(n)\alpha_k'^r(n) + \alpha_k^i(n)\alpha_k'^i(n)] [\alpha_k^i(n)\alpha_k'^r(n) - \alpha_k^r(n)\alpha_k'^i(n)])$$

At $n_0$, the derivatives of $\alpha^r(n)$ and $\alpha^i(n)$ yield $$\alpha_k^r(n_0) = \hat{A}_{k,0}^r$$

$$\alpha_k'^r(n_0) = \left[\frac{\partial}{\partial n}\alpha_k^r(n)\right]_{n=n_0} = -\frac{2\pi}{N}\hat{A}_{k,1}^r$$

$$\alpha_k''^r(n_0) = \left[\frac{\partial^2}{\partial n^2}\alpha_k^r(n)\right]_{n=n_0} = 2\left(\frac{2\pi}{N}\right)^2\hat{A}_{k,2}^r$$

$$\alpha_k^i(n_0) = \hat{A}_{k,0}^i$$

$$\alpha_k'^i(n_0) = \left[\frac{\partial}{\partial n}\alpha_k^i(n)\right]_{n=n_0} = -\frac{2\pi}{N}\hat{A}_{k,1}^i$$

$$\alpha_k''^i(n_0) = \left[\frac{\partial^2}{\partial n^2}\alpha_k^i(n)\right]_{n=n_0} = 2\left(\frac{2\pi}{N}\right)^2\hat{A}_{k,2}^i$$

resulting for the instantaneous amplitudes and frequencies and their derivatives at $n_0$ $$\Psi_k(n_0) = \sqrt{\hat{A}_{k,0}^{r\,2} + \hat{A}_{k,0}^{i\,2}} \tag{71}$$

$$\left[\frac{\partial\Psi_k(n)}{\partial n}\right]_{n=n_0} = -\left(\frac{2\pi}{N}\right)\frac{\hat{A}_{k,0}^r\hat{A}_{k,1}^r + \hat{A}_{k,0}^i\hat{A}_{k,1}^i}{\sqrt{\hat{A}_{k,0}^{r\,2} + \hat{A}_{k,0}^{i\,2}}}$$

$$\left[\frac{\partial\Psi_k(n)}{\partial n^2}\right]_{n=n_0} = 2\left(\frac{2\pi}{N}\right)^2\frac{1}{\left[\hat{A}_{k,0}^{r\,2} + \hat{A}_{k,0}^{i\,2}\right]^{3/2}} \left(\left[\hat{A}_{k,1}^{r\,2} + \hat{A}_{k,1}^{i\,2} + 2\hat{A}_{k,0}^r\hat{A}_{k,2}^r + 2\hat{A}_{k,0}^i\hat{A}_{k,2}^i\right] \left[\hat{A}_{k,0}^{r\,2} + \hat{A}_{k,0}^{i\,2}\right] - \left[\hat{A}_{k,0}^r\hat{A}_{k,1}^r + \hat{A}_{k,0}^i\hat{A}_{k,1}^i\right]^2\right)$$

$$\Phi_k(n_0) = i\arctan\left(\frac{\hat{A}_{k,0}^i}{\hat{A}_{k,0}^r}\right) \tag{72}$$

$$\left[\frac{\partial\Phi_k(n)}{\partial n}\right]_{n=n_0} = 2\pi i\omega_k - i\left(\frac{2\pi}{N}\right)\frac{\hat{A}_{k,0}^r\hat{A}_{k,1}^r - \hat{A}_{k,0}^i\hat{A}_{k,1}^r}{\hat{A}_{k,0}^{i\,2} + \hat{A}_{k,0}^{r\,2}}$$

$$\left[\frac{\partial\Phi_k(n)}{\partial n^2}\right]_{n=n_0} = 2i\left(\frac{2\pi}{N}\right)^2\frac{1}{\left(\hat{A}_{k,0}^{i\,2} + \hat{A}_{k,0}^{r\,2}\right)^2} \left(\left[\hat{A}_{k,0}^r\hat{A}_{k,2}^i - \hat{A}_{k,0}^i\hat{A}_{k,2}^r\right]\left[\hat{A}_{k,0}^{i\,2} + \hat{A}_{k,0}^{r\,2}\right] + \left[\hat{A}_{k,0}^r\hat{A}_{k,1}^r + \hat{A}_{k,0}^r\hat{A}_{k,1}^r\right]\left[\hat{A}_{k,0}^i\hat{A}_{k,1}^r - \hat{A}_{k,0}^r\hat{A}_{k,1}^i\right]\right)$$

Note that the first derivative of the phase is the instantaneous frequency at $n_0$. This can be used for an iterative optimization of the frequency $\omega_k$ yielding $$\omega_k^{(r+1)} = \omega_k^{(r)} - \left(\frac{1}{N}\right)\frac{\hat{A}_{k,0}^r\hat{A}_{k,1}^i - \hat{A}_{k,0}^i\hat{A}_{k,1}^r}{\hat{A}_{k,0}^{i\ 2} + \hat{A}_{k,0}^{r\ 2}} \tag{73}$$

In addition, the amplitude derivatives evaluated at $n_0$ define a second order approximation of the instantaneous amplitude around $n_0$.

$$\Psi_k(n) \approx \Psi_k(n_0) + \left[\frac{\partial\Psi_k(n)}{\partial n}\right]_{n=n_0}(n-n_0) + \frac{1}{2}\left[\frac{\partial^2\Psi_k(n)}{\partial n^2}\right]_{n=n_0}(n-n_0)^2 \tag{74}$$

In the case that the amplitudes are exponentially damped, as frequently occurs for percussive sound, one can equate $$\tilde{A}\exp(\rho_k(n-n_0)) \approx \Psi_k(n_0) + \left[\frac{\partial\Psi_k(n)}{\partial n}\right]_{n=n_0}(n-n_0) + \frac{1}{2}\left[\frac{\partial^2\Psi_k(n)}{\partial n^2}\right]_{n=n_0}(n-n_0)^2 \tag{75}$$

By evaluating both members for $n_0$ one obtains $$\tilde{A}_k \approx \Psi k(n_0) \tag{76}$$

By talking the derivatives of both members and evaluating the expressions for $n_0$ one obtains $$\tilde{A}_k\rho_k \approx \left[\frac{\partial\Psi_k(n)}{\partial n}\right]_{n=n_0} \tag{77}$$

The damping factor ρ can be determined from the two previous equations and Eq. (71), resulting in $$\rho_k \approx -\left(\frac{2\pi}{N}\right)\frac{\hat{A}_{k,0}^r\hat{A}_{k,1}^r + \hat{A}_{k,0}^i\hat{A}_{k,1}^r}{\hat{A}_{k,0}^{i\ 2} + \hat{A}_{k,0}^{r\ 2}} \tag{78}$$

Conclusion

A preferred embodiment of the method according to invention, comprises the step of computing the instantaneous frequencies and the instantaneous amplitudes according to Eq. (69), whereby the instantaneous frequency can be used as a frequency estimate for the next iteration as expressed in Eq. (73). In addition, the method comprises the step of computing damping factor according to Eq. (78), in case that the amplitudes are exponentially damped.

7. Adaptation to Variable Window Lengths

Figure 12:
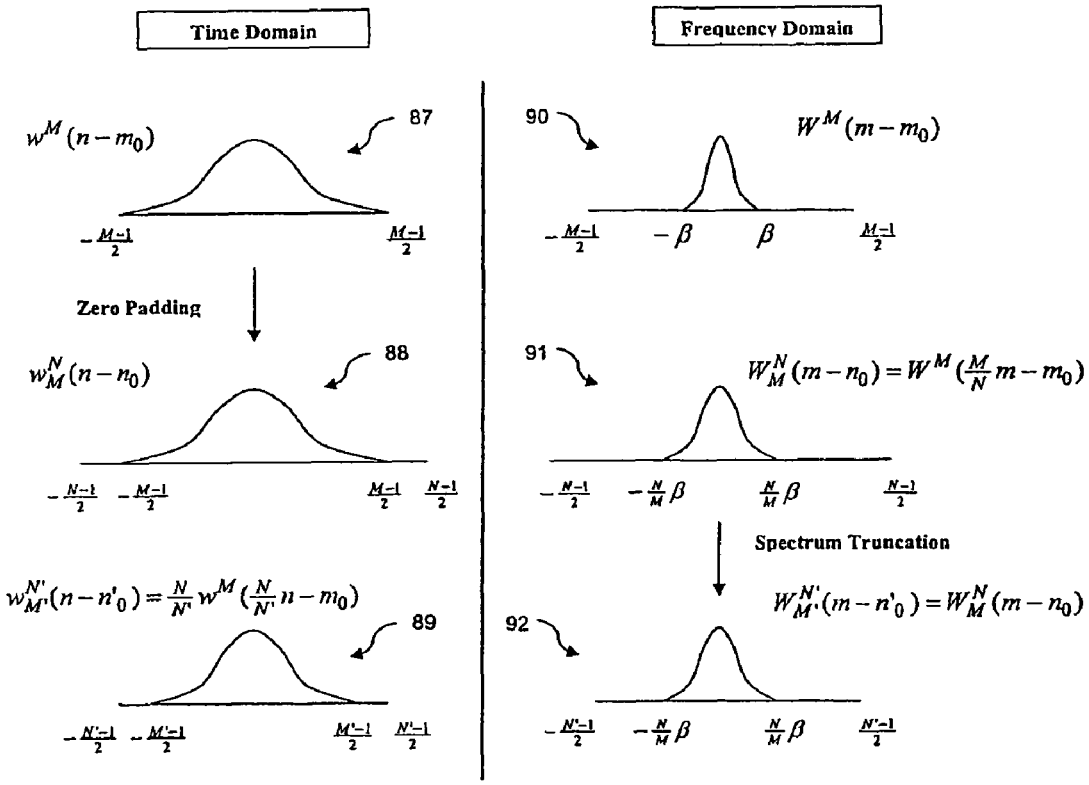
FIG. 12 depicts the theoretic motivation for the scaled look-up table.

The FFT requires that the window size is a power of two. However one can desire to use a window length which is not a power of two. For that case, a scaled table lookup method is disclosed which allows to use arbitrary window lengths which are zero padded up to a power of two. First, a theoretical motivation is given which is represented in FIG. 12. The fourier transform of a window with length M is denoted as yielding $$W^M(m-m_0) \tag{79}$$

When the window is zero padded up to a length N we obtain a new frequency response denoted as $W_M^N(m)$ which can be expressed as a scaled version of $W^M(m)$ yielding $$W_M^N(m-n_0) = W^M\left(\frac{M}{N}m - m_0\right) \tag{80}$$

where m now ranges from 1 to N−1. As a result, the spectral bandwidth of the frequency response is enlarged to $$-\frac{N}{M}\beta \le m \le \frac{N}{M}\beta.$$

In the next step, the spectrum is truncated to a length N' and the inverse fourier transform is taken resulting in $$w_{M'}^{N'}(n-n_0') = \frac{N}{N'}w^M\left(\frac{N}{N'}n - m_0\right) \tag{81}$$

where the rescaled window size is given by M'=M N'/N. The combination of time domain zero padding and frequency domain truncation allows to express a normalized window N'/NωN'/M'(n−n'$_0$) with length M' zero padded up to a length N' in function of $W^M(m)$ using $$\frac{N'}{N}w_{M'}^{N'}(n-n_0') = \frac{1}{N}\sum_{m=0}^{N'-1} W^M\left(\frac{M'}{N'}m - m_0\right)\exp\left(2\pi i\frac{(n-n_0')(m-m_0)}{N'}\right) \tag{82}$$

For the practical implementation, the oversampled main lobe of W(m) is stored in a table $T_i$. The parameters that are required to compute the variable length frequency response given in Eq. (82) are M: window length used to compute the look-up table N': desired FFT size M': desired window size The table has a length $i_L$ and the first index i of the table is denoted $i_0$. These index values correspond with the m-values over a range $[m_a, m_b]$. This leads to the following relation between the input value m and index i $$m = m_a + (m_b - m_a)\frac{i - i_0}{i_L - 1} \tag{83}$$

$$i = i_0 + (i_L - 1)\frac{m - m_a}{m_b - m_a} \tag{84}$$

The values of W(m) are obtained by a simple linear interpolation between the closest i-values yielding $$W(m)=(i-\lfloor i\rfloor)T_{\lfloor i\rfloor}+(1-i+\lfloor i\rfloor)T_{\lfloor i\rfloor+1} \tag{85}$$

where i is computed from m using the previous formula.

When a window with length M' is taken which is zero padded up to a length N', the main lobe is enlarged up to a size $$\frac{\partial^p}{\partial m^p}W(m),$$

Therefore, the synthesis of a frequency $\omega_k$ (see Eq. ??) requires the computation for all frequency domain samples m for which $$m_{min}\leqq m\leqq m_{max}$$

with $$m_{min}=\left\lfloor\omega_k-\frac{N'}{M'}\beta\right\rfloor \tag{86}$$

$$m_{max}=\left\lfloor\omega_k+\frac{N'}{M'}\beta\right\rfloor$$

Conclusion

All previously described algorithms can be adapted to allow arbitrary window lengths zero-padded up to a power of two. Eq. (82) shows that a zeros padded window can be computed by scaling its frequency response. Note that for the derivatives of the frequency responses this scaling must be taking into account. Another result is that the width of the frequency response is enlarged as expressed by Eq. (86).

A preferred embodiment of the method according to the invention, comprises a method to compute the frequency response of a window with length M zero padded up to a length N by using a scaled table look-up according to Eq. (82).

8 Amplitude Computation Pre-Processing

The goal of the pre-processing before the amplitude computation is twofold. On one hand the frequencies are sorted in order to obtain a band diagonal matrix for B. In addition, frequencies that occur twice result in two exact rows in B making it a singular matrix. Therefore, no double frequencies are allowed for the frequency computation.

On the other hand, the preprocessing determines how many diagonals of the matrix B must be taken into account. This is done by counting the number of sinusoidal components that fall in the main lobe of each frequency response. The maximum number of components over all frequency responses yields the value for D.

9 Applications

The computational improvement of the method according to the invention facilitates a large number of applications such as; arbitrary sample rate conversion, multi-pitch extraction, parametric audio coding, source separation, audio classification, audio effects, automated transcription and annotation.

Figure 13:
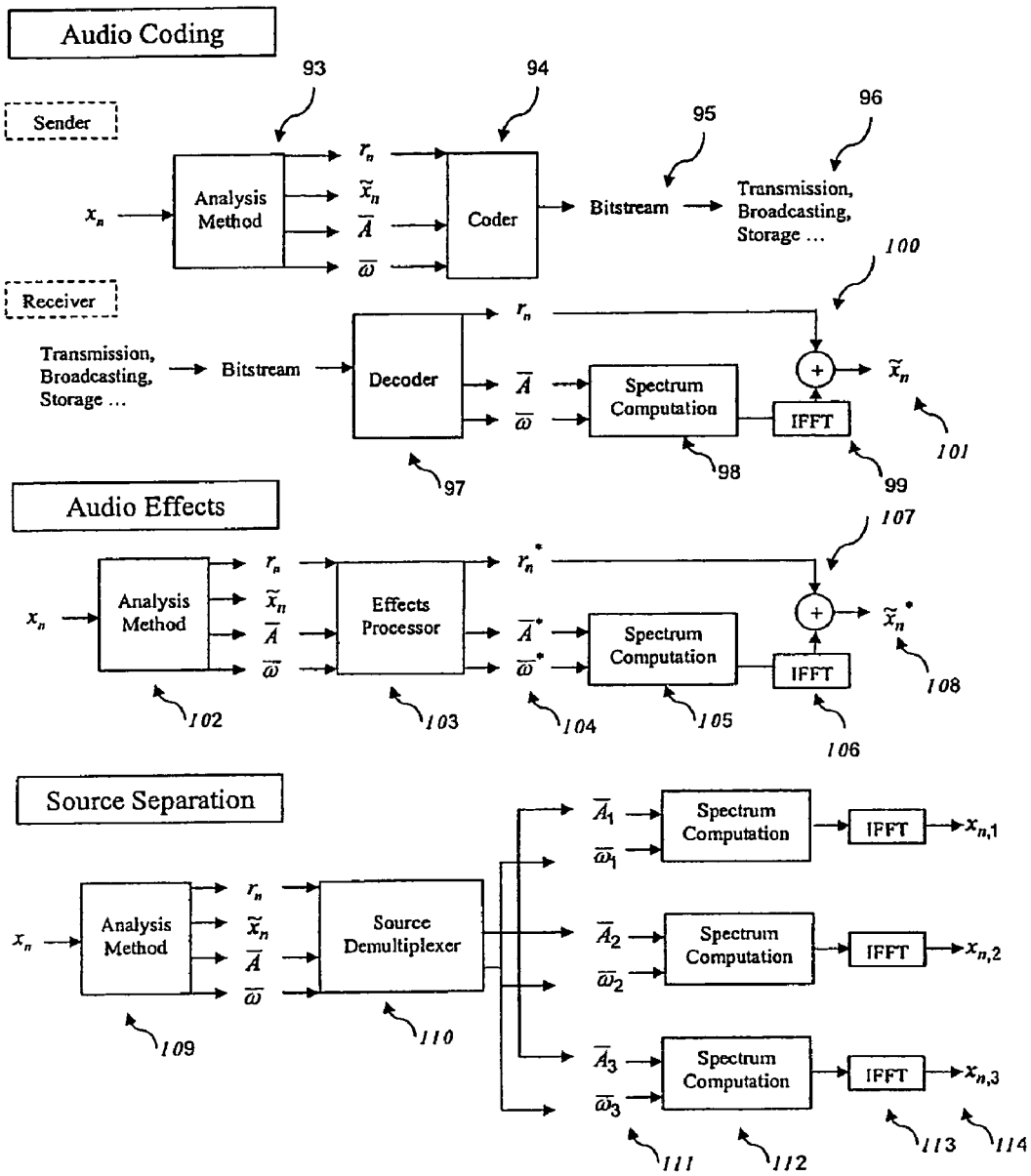
FIG. 13 depicts the applications that are facilitated by the invention. The applications that are illustrated are: 1) audio coding, 2) audio effects, 3) source separation.

Several applications are depicted in FIG. 13.

9.1 Arbitrary Sample Rate Conversion

In section 7 it was shown that the window length can be altered by scaling the frequency response of the sinusoidal components. The fourier transform itself is sinusoidal representation of a sound signal where the frequencies are given by $$\omega_k=\frac{k}{N} \tag{87}$$

with k=0, . . . , N−1. When the Blackmann-Harris is applied, the amplitudes for all these frequencies can be determined by the optimized amplitude estimation method presented in section 3.

When the window size is enlarged by a factor $\alpha$ and the frequencies are divided by the same factor, a resampling of the signal is obtained. The resampling factor $\alpha$ can be any real number and results therefore in an arbitrary sample rate conversion.

9.2 High Resolution (Multi)Pitch Estimation

The efficient analysis method will improve pitch estimation techniques. Current (multi)-pitch estimators based on autocorrelation such as the summary autocorrelation function (SACF) and the enhanced summary autocorrelation function (ESACF), allow to estimate multiple pitches. However, none of these methods takes into account the overlapping peaks that might occur. The frequency optimization for harmonic sources which is presented in this invention allows to improve the fundamental frequencies iteratively leading to very accurate pitch estimations. In addition, very small analysis windows can be used which enable to track fast variations in the pitch in an accurate manner.

9.3 Parametric Audio Coding

The resynthesis of the sound is of a very high quality which is indistinguishable from the original sound. In addition, the amplitudes and frequency parameters vary slowly over time. Therefore, it is interesting to apply our method in the context of parametric coders where these parameters are stored in a differential manner what results in a considerable compression. Evidently, this is interesting for the storage, transmission and broadcasting of digital audio.

9.4 Source Separation

When a multipitch estimator provides good initial values of the pitches the method optimizes all parameters so that an accurate match is obtained. By synthesizing each pitch component to a different signal, the sound sources in the polyphonic recording can be separated.

9.5 Automated Annotation and Transcription

Fast variations in the amplitudes $\overline{A}$ and frequencies $\overline{\omega}$ indicate the beginning and end of a note. Therefore the method will contribute to the automatic annotation and/or transcription of the audio signal.

9.6 Audio Effects

By modifying the frequencies and amplitudes of the different sinusoidal components high quality audio effects can be achieved. The power of this method lies in the fact that frequencies and amplitudes can be manipulated independently. This allows for instance time-stretching, sound morphing, pitch changes, timbre manipulation etc. all with a very high quality.

DETAILED DESCRIPTION OF THE FIGURES

FIG. 1 depicts the complete Analysis/Synthesis method according to the embodiment of the invention. Starting from a windowed short time signal $x_n$ (1) and its fourier transform (2) $X_m$ (3) the initial values of the frequencies (5) are computed (4). These frequencies (5) are then pre-processed (6) and the number of diagonal bands D (7) is determined. The amplitudes (11) are computed from $X_m$, the number of diagonal bands (7) and the pre-processed frequencies (8). The amplitudes (11) and frequencies (8) are used to calculate the spectrum $\tilde{X}_m$ (13). The difference (14) between the synthesized spectrum $\tilde{X}_m$ (13) and the original spectrum $X_m$ (3) yields the residual spectrum $R_m$ (16). This residual spectrum (16), the frequencies (8) and amplitudes (11) are used to optimize (9) the frequency values (5) for the next iteration. A stopping criterium evaluator (17) determines whether the loop is continued. Several criteria were described in section 1.2. When the criterium is met, the iteration is terminated (18). The time-domain model $\tilde{x}_n$ is obtained by taking an inverse fourier transform (19) of the spectrum $\tilde{X}_m$ (13). A short notation is depicted (20) which takes as input the signal $x_n$ and produces a synthesized signal $\tilde{x}_n$, the amplitudes $\overline{A}$ and frequencies $\overline{\omega}$.

FIG. 2 illustrates the band limited property of respectively W(m) (top), W'(m) (middle) and W"(m) (bottom). On the left they are represented on the linear scale. On the right they represented on the dB scale.

FIG. 3 illustrates frequency response of the zero padded Blackmann-Harris window $W_M^N(m)$ (top), the squared Blackmann-Harris window Y(m) (middle) and its second derivative Y"(m) (bottom). Also these frequency responses are band limited and are shown on the linear scale on the left, and on the dB scale on the right.

FIG. 4 depicts the detail of the spectrum computation. On the left hand side the computation is given for the harmonic model. For each sound source k ranging from 0 to S−1 (21), and each component p ranging from 0 to $S_k$−1 belonging to this source (22), the range of m-values is determined (23). Then, for each m-value (24) the frequency response W(m) is computed and multiplied with the amplitude (25). On the right hand side the spectrum computation is shown for the nonstationary model is shown. For each component indexed by k and ranging from 0 to K−1 (26) the range of spectrum samples m is computed (27). Then, for each order p ranging from 0 to P−1 (28) and each spectrum sample m (29) the frequency of the pth derivative of the frequency response W(m) is computed, multiplied with the amplitude $A_{k,p}$ and added to the spectrum $\tilde{X}_m$ (29). (30) shows a short notation for the spectrum calculator.

FIG. 5 illustrates the band diagonal property of the system matrix B that is used for the amplitude computation. As described previously, the matrices $B^{1,1}$ and $B^{1,1}$ can be written in terms of two matrices $Y^+$ (33) and $Y^-$ (32) as indicated by (34). The index k denotes the column of the matrix and l the row. This implies that k−l and k+l indicate respectively the diagonal and antidiagonal of the matrix. By multiplying the diagonal index with the fundamental frequency, the input value for the function Y(m) is obtained which denotes the frequency response of the square window (31). The space complexity is reduced by storing only the relevant diagonals in a 'shifted matrix' $\overleftarrow{B}^{1,1}$ (35).

FIG. 6 depicts the detail of a method of computing the amplitudes of the sinusdoidal components in a sound signal in O(N log N) time, according to the invention. The amplitudes $\overline{A}$ (44) are computed from a spectrum $X_m$ for a given set of frequencies $\overline{\omega}$. This is realized by constructing the matrices $C^1$, $C^2$ (40) and the matrices $$\overleftarrow{B^{1,1}}, \overleftarrow{B^{2,2}} \tag{42}$$

according to Eq. (20). By solving the set of equations represented by these matrices the amplitudes are computed (44). The vectors $C^1$ and $C^2$ are computed by determining for all partials l (36) the range of m values (37), (38) of the main lobe and computing the value for each m-value (40) according to Eq. (20). For the matrices $B^{1,1}$ and $B^{2,2}$, the shifted matrices $$\overleftarrow{B^{1,1}} \text{ and } \overleftarrow{B^{2,2}}$$

are computed containing only the band diagonal elements. The width of the band is denoted D, For all k values from 0 to 2D (41) each row of the matrices $$\overleftarrow{B^{1,1}} \text{ and } \overleftarrow{B^{2,2}}$$

is computed (42) according to Eq. (20). The equations denoted in Eq. (19) can now be solved directly on the shifted versions of $B^{1,1}$ $B^{2,2}$, (43) yielding the amplitude values (44). A short notation for the computation is denoted by (45).

FIG. 7, depicts the frequency optimization for the non harmonic model according to the embodiment of the invention. It shows how the gradient and system matrix are computed for different optimization methods as described in section 4. For each sinusoidal component (46), the relevant range of spectrum samples m is determined (47). Over this range (48), the gradient elements and the diagonal elements of the system matrix are computed (49) according to Eq. (41). Then, all diagonals k (50) of the system matrix are computed (51) according to Eq. (41). In addition, a regularization term is added to the diagonal elements (51) according to Eq. (38). The optimization step (54) is computed by solving the set of equations (53). A short notation is denoted by (55). As follows from Eq. 42, the parameters $\lambda_1$ and $\lambda_2$ allow to switch between different optimization methods and allow to regularize the system matrix.

FIGS. 8 and 9 depict the frequency optimization for the harmonic model according to the embodiment of the invention. For each sinusoid q (57) of a source l (57), the relevant range of spectrum samples m is determined (58). This range is used (59) for the computation of gradient h and diagonal elements of the system matrix H (60) according to Eq. 49. In a subroutine (61), (66) the other elements of H are computed. For each matrix column k (67), the ranges of r-values are determined (68, 71, 74) and matrix elements are computed (70, 73, 76) over these values (69, 72, 75), according to Eq. (49). After the subroutine (77, 62), the regularization term $\lambda_2$ (63) is added to the diagonal values. Finally the optimization step $\Delta(\omega)$ (65) is computed by solving the equations (64).

FIG. 10 shows the band diagonal submatrices for each (p.q)-couple. All relevant values are positioned around the main diagonal by inverting the indexation order.

Figure 11:
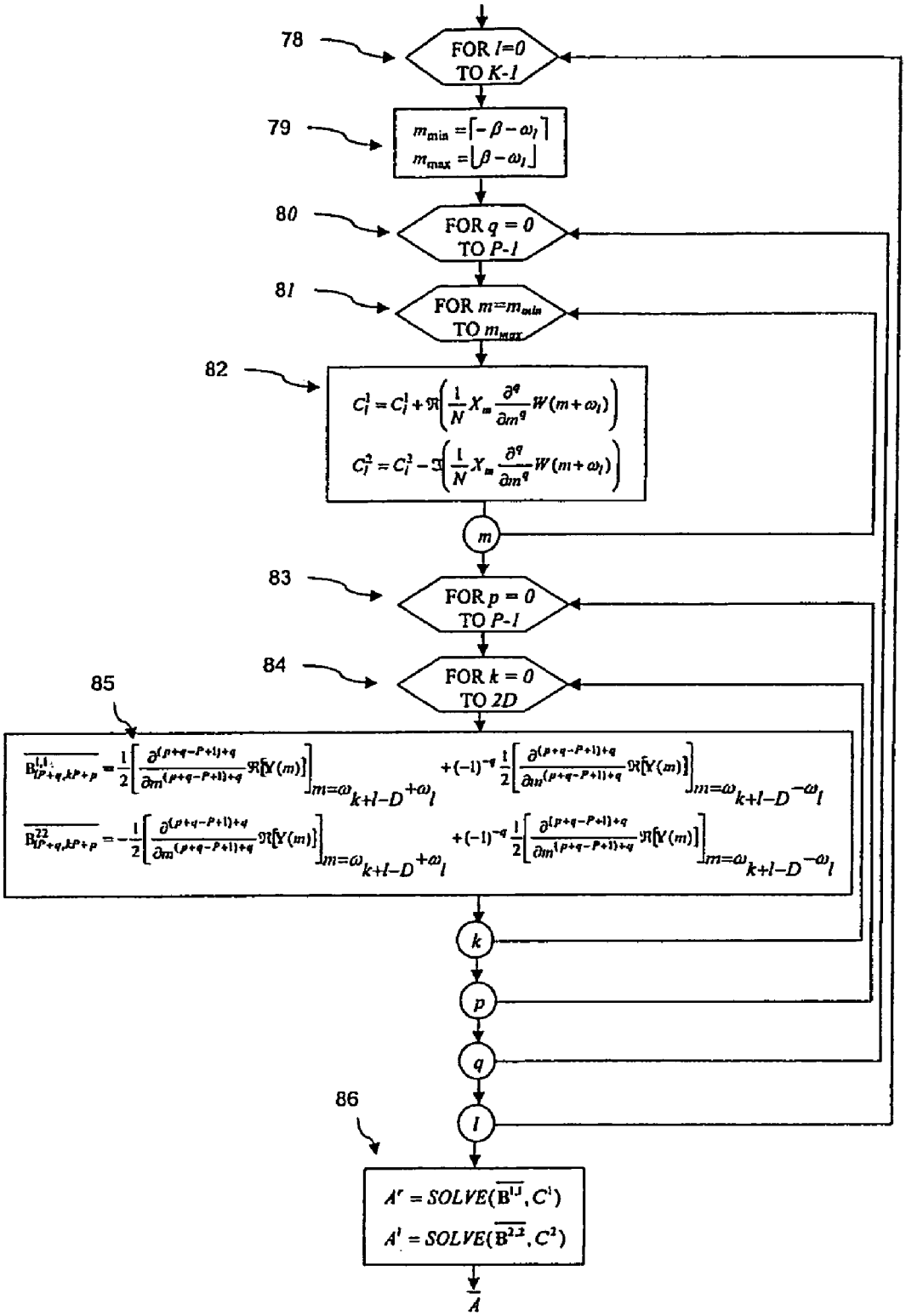
FIG. 11 depicts the optimized amplitude computation for the complex polynomial amplitudes.

FIG. 11 depicts the embodiment of the polynomial amplitude computation as defined in Eq. (56). For each component l (78) the range of m-values is determined (79). The values $C^1$ and $C^2$ are computed (82) by iterating over q (80) and m (81). The diagonal bands of $B^{1,1}$ and $B^{2,2}$ are computed (85) and stored in $$\overleftarrow{B^{1,1}} \text{ and } \overleftarrow{B^{2,2}}$$

by iterating over l (78), p (83), q (80) and k (84). Finally, the complex polynomial amplitudes are computed by solving the equations (86).

FIG. 12 illustrates the theoretic motivation for a scaled table look-up. A time domain window of length M, denoted by $w^{\mathcal{M}}(n)$ (87) is considered for which the frequency response (90) is bandlimited within a range $[-\beta,\beta]$. When this window is zero padded up to a length N (88) this results in a scaling in the frequency domain (91). Then, the spectrum is truncated (92) resulting in a length N'. When taking the inverse fourier transform of this truncated spectrum, a window with length M' zero padded up to a length N' is obtained (89).

FIG. 13 shows several applications of the analysis method according to the embodiment of the invention. The top of the figure illustrates the application of the invention (93) in the context of parametric/sinusoidal audio coding. At the sender side, the amplitudes $\overline{A}$, frequencies $\overline{\omega}$ and noise residual $r_n$ are encoded (94) in a bitstream (95) which can be stored, broadcasted or transmitted (96). At the receiver side, the decoder (97) computes the amplitudes $\overline{A}$, frequencies $\overline{\omega}$ and noise residual $r_n$ back from the bitstream. Subsequently, the spectrum is computed (98) and by taking the IFFT (99) and adding the noise residual (100), the signal model is computed (101).

In the middle of the figure, it is shown how the invention (102) facilitates advanced audio effects. The parameters $\overline{A}$, $\overline{\omega}$ and the noise residual $r_n$ are processed by an effects processor (103) yielding the processed values $\overline{A}^*$, $\overline{\omega}^*$ and $r^*_n$ (104). With these values, the spectrum is computed (105), an IFFT is taken (106) and the modified residual $r^*_n$ is added (107), resulting in the modified signal $\tilde{x}_n$ (108).

At the bottom of the figure, the application of the invention (109) is depicted in the context of source separation. A source demultiplexer (110) classifies all component by their sound source (111). By computing the spectrum (112) and taking the inverse transform (113), the different sources are synthesized separately (114).

What is claimed is:

1. A method for processing a windowed signal representing sound, the method comprising, by a signal processing apparatus, computing simultaneously the frequencies and complex amplitudes from the signal using a nonlinear least squares method, whereby the computational complexity is reduced by taking into account the bandlimited property of the window resulting in band-diagonal system matrices for the computation of the amplitudes and frequency optimization step.

2. The method according to claim 1 using a stationary nonharmonic signal model according to (Eq. (2)):

$$\tilde{x}_n = \Re\left[w_n \sum_{k=0}^{K-1} A_k \exp\left(-2\pi i \omega_k \frac{n-n_0}{N}\right)\right] \tag{2}$$

which is a model with K stationary components where each component is characterized by its complex amplitude $A_k$ and frequency $\omega_k$, where $w_n$ is the window of claim 1; or an harmonic signal model according to (Eq. (3)):

$$\tilde{x}_n = \Re\left[w_n \sum_{k=0}^{S-1} \sum_{p=0}^{S_k-1} A_{k,p} \exp\left(-2\pi i p \omega_k \frac{n-n_0}{N}\right)\right] \tag{3}$$

which is a model with S quasi-periodic stationary sound sources with a fundamental frequency $\omega_x$, each consisting of $S_k$ sinusoidal components with frequencies that are integer multiples of $\omega_k$, in which the complex amplitude of the pth component of the kth source is denoted $A_{k,p}$, and where $w_n$ is the window of claim 1.

3. The method according to claim 1 using a nonstationary nonharmonic model according to (Eq. (4)):

$$\tilde{x}_n = \Re\left[w_n \sum_{k=0}^{K-1} \sum_{p=0}^{P-1} A_{k,p} \left(-2\pi i \frac{n-n_0}{N}\right)^p \exp\left(-2\pi i \omega_k \frac{n-n_0}{N}\right)\right] \tag{4}$$

which is a model with K nonstationary sinusoidal components which have independent frequencies $\omega_k$, in which the amplitudes $A_{k,p}$ denote the p-th order of the k-th sinusoid, and where $w_n$ is the window of claim 1.

4. The method according to claim 2, comprising the computation of the spectrum as a linear combination of the frequency responses of the window according to (Eq. (11)):

$$\tilde{X}_m = \sum_{k=0}^{K-1} A_k W(m + \omega_k) \tag{11}$$

for the stationary nonharmonic model, or (Eq. (12)):

$$\tilde{X}_m = \sum_{k=0}^{S-1} \sum_{p=0}^{S_k-1} A_{k,p} W(m + p w_k) \tag{12}$$

for the harmonic model, where the fourier transform of a complex signal results in a spectrum $\tilde{X}_m$, where W(m) denotes the discrete time fourier transform of $w_n$ and whereby only the main lobes of the responses are computed by using look-up tables.

5. The method according to claim 3, comprising the computation of the spectrum as a linear combination of the frequency responses of the window according to (Eq. (13)):

$$\tilde{X}_m = \sum_{n=0}^{N-1} w_n \left[ \sum_{k=0}^{K-1} \sum_{p=0}^{P-1} A_{k,p} \left(-2\pi i \frac{n-n_0}{N}\right)^p \exp\left(-2\pi i w_k \frac{n-n_0}{N}\right) \right] \exp\left(-2\pi i m \frac{n-n_0}{N}\right) = \sum_{k=0}^{K-1} \sum_{p=0}^{P-1} A_{k,p} \left[ \sum_{n=0}^{N-1} w_n \left(-2\pi i \frac{n-n_0}{N}\right)^p \exp\left(-2\pi i (w_k + m) \frac{n-n_0}{N}\right) \right] = \sum_{k=0}^{K-1} \sum_{p=0}^{P-1} A_{k,p} \frac{\partial^p}{\partial m^p} W(w_k + m) \tag{13}$$

for the nonstationary model, where the fourier transform of a complex signal results in a spectrum $\tilde{X}_m$, where W(m) denotes the discrete time fourier transform of $w_n$ whereby only the main lobes of the responses are computed by using look-up tables.

6. The method according to claim 2, comprising the step of computing the stationary complex amplitudes, by solving the equations (Eq. (19)):

$$\begin{bmatrix} B^{1,1} & B^{1,2} \\ B^{2,1} & B^{2,2} \end{bmatrix} \begin{bmatrix} A^r \\ A^i \end{bmatrix} = \begin{bmatrix} C^1 \\ C^2 \end{bmatrix} \tag{19}$$

where $$B^{1,1}_{l,k} = \sum_{n=0}^{N-1} w_n^2 \cos\left(2\pi w_k \frac{n-n_0}{N}\right) \cos\left(2\pi w_l \frac{n-n_0}{N}\right)$$

$$B^{1,2}_{l,k} = \sum_{n=0}^{N-1} w_n^2 \sin\left(2\pi w_k \frac{n-n_0}{N}\right) \cos\left(2\pi w_l \frac{n-n_0}{N}\right)$$

$$B^{2,1}_{l,k} = \sum_{n=0}^{N-1} w_n^2 \cos\left(2\pi w_k \frac{n-n_0}{N}\right) \sin\left(2\pi w_l \frac{n-n_0}{N}\right)$$

$$B^{2,2}_{l,k} = \sum_{n=0}^{N-1} w_n^2 \sin\left(2\pi w_k \frac{n-n_0}{N}\right) \sin\left(2\pi w_l \frac{n-n_0}{N}\right)$$

$$C^1_l = \sum_{n=0}^{N-1} x_n w_n \cos\left(2\pi w_l \frac{n-n_0}{N}\right)$$

$$C^2_l = \sum_{n=0}^{N-1} x_n w_n \sin\left(2\pi w_l \frac{n-n_0}{N}\right)$$

using (Eq. (20)):

$$B^{1,1}_{l,k} = \frac{1}{2}\Re(Y(w_k + w_l)) + \frac{1}{2}\Re(Y(w_k - w_l)) \tag{20}$$

$$B^{1,2}_{l,k} = -\frac{1}{2}\mathcal{J}(Y(w_k + w_l)) - \frac{1}{2}\mathcal{J}(Y(w_k - w_l))$$

$$B^{2,1}_{l,k} = -\frac{1}{2}\mathcal{J}(Y(w_k + w_l)) + \frac{1}{2}\mathcal{J}(Y(w_k - w_l))$$

$$B^{2,2}_{l,k} = -\frac{1}{2}\Re(Y(w_k + w_l)) + \frac{1}{2}\Re(Y(w_k - w_l))$$

-continued $$C^1_l = \Re\left(\frac{1}{N}\sum_{m=0}^{N-1} X_m W(m + w_l)\right)$$

$$C^2_l = -\mathcal{J}\left(\frac{1}{N}\sum_{m=0}^{N-1} X_m W(m + w_l)\right)$$

such that only the elements around the diagonal of B are taken into account, whereby a shifted form $\overleftarrow{B}$ computed containing only D diagonal bands of B according to (Eq. (27)):

$$\overleftarrow{B^{1,1}}_{l,k} = B^{1,1}_{l,l+k-D} \tag{27}$$

$$\overleftarrow{B^{2,2}}_{l,k} = B^{2,2}_{l,l+k-D}$$

and Eq. (20), whereby the computation of the Eq. (20) requires the computation of the frequency response of the window and the square window denoted by W(m) and Y(m) respectively, and solving equation given by Eq. (19) directly from $\overleftarrow{B}$ and C in (Eq. (28)):

$$A^r = \mathrm{SOLVE}\left(\overleftarrow{B^{1,1}}, C^1\right) \tag{28}$$

$$A^i = \mathrm{SOLVE}\left(\overleftarrow{B^{2,2}}, C^2\right)$$

by an adapted gaussian elimination procedure.

7. The method according to claim 2, further comprising the step of optimizing the frequencies for the stationary nonharmonic model by solving the equation (Eq. (34)):

$$H\Delta\omega = h \tag{34},$$

using (Eq. (42)):

$$\Delta w_l = \hat{w}_l - w_l \tag{42}$$

$$h_l = -\frac{2}{N}\Re\left(A_l \sum_{m=0}^{N-1} R_m W'(\hat{w}_l - m))\right)$$

$$H_{lk} = \Re(A_k A_l Y''(\hat{w}_k + \hat{w}_l)) - \Re(A_k A_l^* Y''(\hat{w}_k - \hat{w}_l)) - \lambda_1 \delta_{kl} \frac{2}{N}\Re\left(A_l \sum_{m=0}^{N-1} R_m W''(\hat{w}_l - m)\right) + \delta_{kl}\lambda_2$$

such that only elements around the diagonal of H are taken into account, whereby a shifted form $\overleftarrow{H}$ is computed containing only D diagonal bands according to (Eq. (36)):

$$\overleftarrow{H}_{lk} = H_{l,l+k-D} \tag{36}$$

and Eq. (42), whereby the gradient h is computed from the residual spectrum $R_m$, where $R_m = X_m - \tilde{X}_m$ denotes the spectrum of the residual $r_n$, and from amplitude $A_l$ and frequencies $\omega_l$, and requires the computation of derivative of the frequency response of the window W'(m), whereby the first term of H requires the computation of the second derivative of the frequency response of the square window denoted Y"(m), whereby the second term of H is computed from the residual spectrum $R_m$, amplitude $A_l$ and frequencies $\omega_l$, and requires the computation of the second derivative of the frequency response W"(m), whereby the parameter $\lambda_1$ allows to switch between different optimization methods and the parameter $\lambda_2$ regularizes the system matrix, and computing the optimization step by solving the system of equations directly on $\overleftarrow{H}$ and h according to (Eq. (37)):

$$\Delta\overline{\omega} = \mathrm{SOLVE}(\overleftarrow{H}, h) \tag{37}$$

by an adapted gaussian elimination procedure.

8. The method according to claim 2, further comprising the step of optimizing the frequencies for the harmonic signal model, by computing the optimization step solving (Eq. (48)):

$$H\Delta\omega = h \tag{48}$$

using (Eq. (49)):

$$\Delta w_l = \hat{w}_l - w_l \tag{49}$$

$$h_l = -\frac{2}{N}\sum_{q=1}^{S_l-1}\Re\left(\sum_{m=0}^{N-1} R_m q A_{l,q} W'(qw_l - m)\right)$$

$$H_{l,k} = \sum_{q=1}^{S-1}\left[\sum_{r=1}^{r_{max,1}} qr\Re(A_{p,q}A_{l,r}Y''(qw_p + rw_l) + \sum_{r=r_{min,2}}^{r_{max,2}} qr\Re(A_{p,q}A_{l,r}Y''(qw_p + rw_l) - \sum_{r=r_{min,3}}^{r_{max,3}} qr\Re(A_{p,q}A^*_{l,r}Y''(qw_p - rw_l)\right] -$$

$$\lambda_1\delta_{lp}\frac{2}{N}\Re\left(\sum_{q=1}^{S_l-1}\sum_{m=0}^{N-1} R_m q^2 A_{p,q} W''(qw_p - m)\right) + \delta_{lp}\lambda_2$$

whereby the gradient h is computed from the residual spectrum $R_m$, where $R_m = x_m - \hat{X}_m$ denotes the spectrum of the residual $r_n$ and W'(m), and from amplitude $A_l$ and frequencies $\omega_l$, and requires the computation of derivative of the frequency response of the window W'(m), whereby the first term of H requires the computation of the second derivative of the frequency response of the square window denoted Y"(m), whereby the second term of H is computed from the residual spectrum $R_m$, amplitude $A_l$ and frequencies $\omega_l$, and requires the computation of the second derivative of the frequency response W"(m), whereby the parameter $\lambda_1$ allows to switch between different optimization methods and the parameter $\lambda_2$ regularizes the system matrix.

9. The method according to claim 1, further comprising the step of computing the polynomial complex amplitudes by solving the equation (Eq. (55)):

$$\begin{bmatrix} B^{1,1} & B^{1,2} \\ B^{2,1} & B^{2,2} \end{bmatrix}\begin{bmatrix} A^1 \\ A^2 \end{bmatrix} = \begin{bmatrix} C^1 \\ C^2 \end{bmatrix} \tag{55}$$

using (Eq. (63)):

$$\begin{aligned}
B^{1,1}_{lP+q,kP+p} &= \frac{1}{2}\left[\frac{\partial^{p+q}}{\partial m^{p+q}}\Re[Y(m)]\right]_{m=w_k+w_l} + (-1)^{-q}\frac{1}{2}\left[\frac{\partial^{p+q}}{\partial m^{p+q}}\Re[Y(m)]\right]_{m=w_k-w_l} \\
B^{1,2}_{lP+q,kP+p} &= -\frac{1}{2}\left[\frac{\partial^{p+q}}{\partial m^{p+q}}\mathcal{J}[Y(m)]\right]_{m=w_k+w_l} - (-1)^{-q}\frac{1}{2}\left[\frac{\partial^{p+q}}{\partial m^{p+q}}\mathcal{J}[Y(m)]\right]_{m=w_k-w_l} \\
B^{2,1}_{lP+q,kP+p} &= \frac{1}{2}\left[\frac{\partial^{p+q}}{\partial m^{p+q}}\mathcal{J}[Y(m)]\right]_{m=w_k+w_l} + (-1)^{-q}\frac{1}{2}\left[\frac{\partial^{p+q}}{\partial m^{p+q}}\mathcal{J}[Y(m)]\right]_{m=w_k-w_l} \\
B^{2,2}_{lP+q,kP+p} &= \frac{1}{2}\left[\frac{\partial^{p+q}}{\partial m^{p+q}}\Re[Y(m)]\right]_{m=w_k+w_l} + (-1)^{-q}\frac{1}{2}\left[\frac{\partial^{p+q}}{\partial m^{p+q}}\Re[Y(m)]\right]_{m=w_k-w_l} \\
C^1_{lP+q} &= \Re\left(\frac{1}{N}\sum_{m=0}^{N-1} X_m\frac{\partial^q}{\partial m^q}W(m+w_l)\right) \\
C^2_{lP+q} &= -\mathcal{J}\left(\frac{1}{N}\sum_{m=0}^{N-1} X_m\frac{\partial^q}{\partial m^q}W(m+w_l)\right) \\
A^1_{kP+p} &= A^r_{k,p} \\
A^2_{kP+p} &= A^i_{k,p}
\end{aligned} \tag{63}$$

such that only the elements around the diagonal of B are taken into account, whereby a shifted form $\overleftarrow{B}$ computed containing only PD diagonal bands of B according to (Eq. (64)):

$$\begin{aligned}
\overleftarrow{B^{1,1}}_{lP+q,kP+p} &= B^{1,1}_{lP+q,lP+q+kP+p-(D+1)P+1} = B^{1,1}_{lP+q,(k+l-D)P+(p+q-P+1)} \\
\overleftarrow{B^{2,2}}_{lP+q,kP+p} &= B^{2,2}_{lP+q,lP+q+kP+p-(D+1)P+1} = B^{2,2}_{lP+q,(k+l-D)P+(p+q-P+1)}
\end{aligned} \tag{64}$$

and Eq. (63), whereby the computation is required of the frequency response of the square window and its derivatives $$\frac{\partial^p}{\partial m^p}Y(m)$$

whereby the computation is required of the frequency response of the window and its derivatives $$\frac{\partial^p}{\partial m^p}W(m),$$

and solving the equation given by Eq. (55) directly from $\overline{B}$ and C by an adapted gaussian elimination procedure.

10. The method according to claim 6 or 9, comprising a preprocessing step which comprises:

sorting the frequencies to obtain a band diagonal matrix D, determining the number of diagonal bands D being defined as the largest k−l for which $-\beta \leqq \omega_k - \omega_l \leqq \beta$, where $\omega_k$ and $\omega_l$ denote two frequency values and β the width of the main lobe of the frequency response of the window.

11. The method according to claim 1, further comprising the step of computing instantaneous frequencies and instantaneous amplitudes according to (Eq. (69)):

$$\psi_k(n) = \sqrt{\left(\sum_{p=0}^{P-1} \hat{A}_{k,p}^{r}\left(-2\pi\frac{n-n_0}{N}\right)^p\right)^2 + \left(\sum_{p=0}^{P-1} \hat{A}_{k,p}^{i}\left(-2\pi i\frac{n-n_0}{N}\right)^p\right)^2} \tag{69}$$

$$\Phi_k(n) = 2\pi i w_k \frac{n-n_0}{N} + i\arctan\left(\frac{\sum_{p=0}^{P-1} \hat{A}_{k,p}^{i}\left(-2\pi\frac{n-n_0}{N}\right)^p}{\sum_{p=0}^{P-1} \hat{A}_{k,p}^{r}\left(-2\pi i\frac{n-n_0}{N}\right)^p}\right)$$

whereby the instantaneous frequency can be used as a frequency estimate for the next iteration as expressed in (Eq. (73)):

$$\omega_k^{(r+1)} = \omega_k^{(r)} - \left(\frac{1}{N}\right)\frac{\hat{A}_{k,0}^{r}\hat{A}_{k,1}^{i} - \hat{A}_{k,0}^{i}\hat{A}_{k,1}^{r}}{\hat{A}_{k,0}^{i2} + \hat{A}_{k,0}^{r2}}. \tag{73}$$

12. The method according to claim 1, further comprising the step of computing damping factor according to (Eq. (78)):

$$\rho_k \approx -\left(\frac{2\pi}{N}\right)\frac{\hat{A}_{k,0}^{r}\hat{A}_{k,1}^{r} + \hat{A}_{k,0}^{i}\hat{A}_{k,1}^{i}}{\hat{A}_{k,0}^{i2} + \hat{A}_{k,0}^{r2}} \tag{78}$$

in case that the amplitudes are exponentially damped.

13. The method according to claim 1, where a scaled frequency response is used for the analysis of a zero padded window, where $W_M(m-m_0)$ denotes the frequency response of the window of length M and $$W_M^N(m-n_0) = W^M\left(\frac{M}{N}m - m_0\right)$$

the zero padded version of this window up to a length N, and $$w_{M'}^{N'}(n-n_0) = \frac{N}{N'}W^M\left(\frac{N}{N'}n - m_0\right)$$

the inverse transform of the truncated spectrum to a length N' reducing the window length to $$M' = \frac{M}{N}N',$$

resulting in a scaled and zero padded version of the window by computing the inverse transform of the scaled frequency response yielding (Eq. (1)):

$$\frac{N'}{N}w_{M'}^{N'}(n-n_0') = \frac{1}{N}\sum_{m=0}^{N'-1} W^M\left(\frac{M'}{N'}m - m_0\right)\exp\left(2\pi i\frac{(n-n_0')(m-m_0)}{N'}\right) \tag{1}$$

14. The method according to claim 1 for accurate pitch estimation, wherein the windowed signal is a sound having a pitch and the method further comprises accurately estimating said pitch based on the computed frequencies and complex amplitudes.

15. The method according to claim 1, wherein the method is applied to determine arbitrary sample rate conversion.

16. The method according to claim 1, wherein the windowed signal is a sound and wherein noise residual, the amplitudes and the frequencies are encoded in a bitstream which is stored, broadcasted or transmitted at a sender side of a parametric/sinusoidal audio coder, and a receiver decodes the bitstream back to the parameters and synthesizes the sound.

17. The method according to claim 1 for audio effects whereby noise $r_n$, the amplitudes $\overline{A}$ and the frequencies $\overline{\omega}$ are manipulated by an effects processor yielding $r^*_n$, $\overline{A}^*$ and $\overline{\omega}^*$ and synthesized with these modified parameters.

18. The method according to claim 1 for source separation, whereby sinusoidal components originating from the same sound source are grouped and synthesized separately.

19. The method according to claim 1 for automated annotation and transcription whereby the signal is segmented according to the values of the amplitudes and frequencies.

* * * * *